US009062947B1

(12) United States Patent
Patel

(10) Patent No.: US 9,062,947 B1
(45) Date of Patent: Jun. 23, 2015

(54) ELECTRONIC GAME TRACKING DEVICE

(76) Inventor: Bhavik G. Patel, Elk Grove Village, IL (US)

( * ) Notice: Subject to any disclaimer, the term of this patent is extended or adjusted under 35 U.S.C. 154(b) by 235 days.

(21) Appl. No.: 13/374,672

(22) Filed: Jan. 6, 2012

(51) Int. Cl.
*F42B 6/04* (2006.01)
*F42B 12/38* (2006.01)

(52) U.S. Cl.
CPC ..... *F42B 12/385* (2013.01); *F42B 6/04* (2013.01)

(58) Field of Classification Search
USPC ..... 473/570, 578
See application file for complete search history.

(56) References Cited

U.S. PATENT DOCUMENTS

| | | | |
|---|---|---|---|
| 3,790,948 | A | 2/1974 | Ratkovich |
| 4,704,612 | A | 11/1987 | Boy et al. |
| 4,885,800 | A | 12/1989 | Ragle |
| 4,940,245 | A | 7/1990 | Bittle, Jr. |
| RE33,470 | E | 12/1990 | Boy et al. |
| 5,157,405 | A | 10/1992 | Wycoff et al. |
| 6,856,250 | B2 | 2/2005 | Hilliard |
| 7,316,202 | B2 | 1/2008 | Fantin et al. |
| 7,598,869 | B2 | 10/2009 | Kumagai |
| 7,965,188 | B2 | 6/2011 | Geissler |
| 2003/0132846 | A1 | 7/2003 | Hilliard |
| 2004/0048703 | A1 | 3/2004 | Cyr et al. |
| 2005/0231362 | A1 | 10/2005 | Pridmore, Jr. |
| 2007/0042844 | A1 | 2/2007 | Stote, III |
| 2007/0142137 | A1 | 6/2007 | Davenhaver |
| 2008/0248903 | A1 | 10/2008 | Cyr et al. |
| 2009/0098958 | A1 | 4/2009 | Miner |
| 2009/0231190 | A1 | 9/2009 | Grumbles |
| 2010/0035709 | A1 | 2/2010 | Russell |

FOREIGN PATENT DOCUMENTS

| | | |
|---|---|---|
| WO | WO2008100430 | 8/2008 |

*Primary Examiner* — John Ricci
(74) *Attorney, Agent, or Firm* — Brie A. Crawford

(57) ABSTRACT

An electronic game tracking device is attached an arrow to be used in hunting. When the arrow strikes a game animal, barbs on the electronic game tracking device attach that device to the game animal, which electronic game tracking device then allows a hunter to readily track and find a wounded animal with a compatible receiver. The electronic game tracking device is still easily transported and utilized.

17 Claims, 28 Drawing Sheets

ELECTRONIC GAME TRACKING DEVICE

This invention relates to an electronic game tracking device, and more particularly to an electronic game tracking device, which is attached to an arrow in order permit electronic tracking of an animal struck by an arrow after the arrow is loosed or shot from a bow.

BACKGROUND OF THE INVENTION

Bow hunting for deer, ellk, bears, caribou, moose, turkey, fish, or other game animals is a widely enjoyed sport. Individual states set laws dictating the legality of bow hunting including the permissible time period, type of game, setting designated hunting areas, and other factors.

Bow hunters shoot game in much closer proximity to the game animal than shotgun or rifle hunters. Also, unlike shotgun or rifle hunting, when an animal is struck with an arrow, it almost always runs long distances. The wounded animal is not always easily trackable. Bow hunters generally track the animal by following a blood trait, using scent hounds, following the disruption in the terrain, or luck. It can be very inhumane to the animal to prolong the suffering when the hunter cannot find the body. A device that will make tracking the wounded animal more convenient or efficient is a useful invention.

Bow hunting requires the hunter to carry many tools and supplies long distances. For example, the hunter must carry a bow, a supply of arrows, binoculars, scent sticks, clothing, and other related gear. Electronic game tracking devices are known, but many are large and cumbersome and not easily carried. An electronic game tracking device that is small, lightweight, and easily carried is a useful invention.

Moreover, when a hunter shoots a bow, the arrow can contact the animal and travel entirely through the body. If the electronic game tracking device remains with the arrow, it will not allow the hunter to readily find the wounded animal. An electronic game tracking device which stays with the animal even if the arrow traverses through the body, is a useful invention.

Bow hunters precisely align their shot when a target animal is spotted. Many factors, such as distance from the animal and environmental conditions, are considered when aligning the shot. Any additions to the arrow can easily alter the trajectory of the arrow and cause the hunter to miss the target animal. An electronic game tracking device that does not cause interference, with the trajectory of the arrow is a useful invention.

A bow hunter must be able to receive a signal from an electronic game tracking device in order to readily find a wounded animal. However, there may be interference with the signal if the equipment is blocked by an object, such as the body of the animal or other environmental factors. An electronic game tracking device which can send a signal through an object is a useful invention.

SUMMARY OF THE INVENTION

Among the many objectives of the present invention is the provision of an electronic game tracking device which expedites the process of locating a wounded animal.

Also, another objective of the present invention is the provision of an electronic game tracking device which is not cumbersome and is easily carried by hunters.

Moreover, another objective of the present invention is the provision of an electronic game tracking device that stays with the animal in the event the arrow traverses the body.

A still further objective of the present invention is the provision of an electronic game tracking device which has minimal interference with the trajectory of the arrow.

Yet another objective of the present invention is the provision of an electronic game tracking device which can transmit signals through objects including the body of the animal.

Still a further objective of the present invention is the provision of an electronic game tracking device which is compatible will all makes, brands, and models of arrows.

Furthermore, another objective of the present invention is the provision of an electronic game tracking device which is able to be specifically located without interference from other tracking devices, cell phones, or other electronic devices which may be in the area.

Also, another objective of the present invention is the provision of an electronic game tracking device which allows the hunter to enter information about the specific sending unit and only receive signals from this specific sending unit.

Still, another objective of the present invention is the provision of an electronic game tracking device which uses Radio Frequency Identification technology to allow the sending unit and the receiving unit to communicate between each other.

Finally, an objective of the present invention is the provision of an electronic game tracking device which can provide indications of signal strength and direction received from the sending unit.

These and other objectives of the invention (which other objectives become clear by consideration of the specification, claims and drawings as a whole) are met by providing an electronic game tracking device which uses Radio Frequency Identification Technology to allow a hunter to readily find a wounded animal but is still easily transported and utilized.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
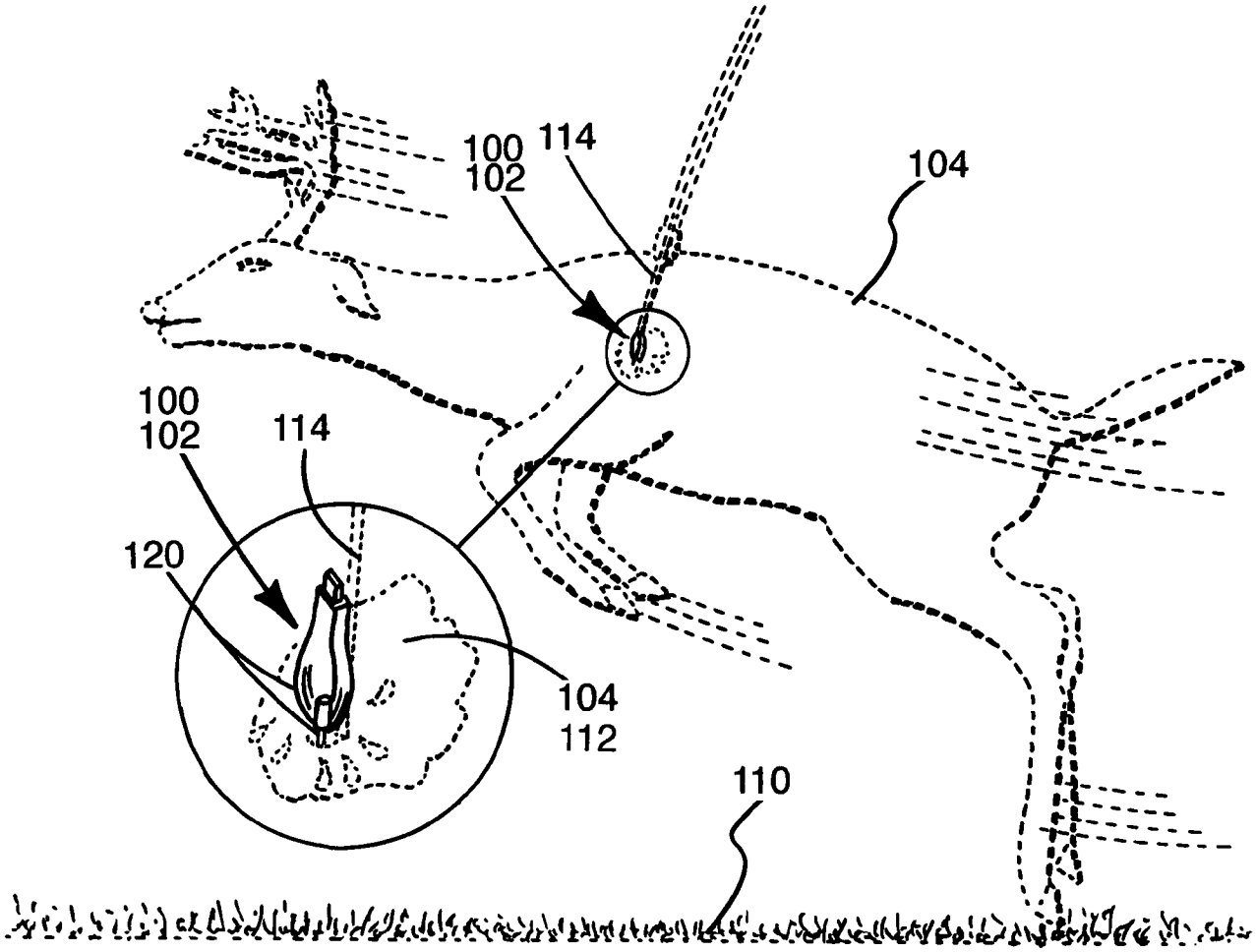
FIG. 1 depicts a side, perspective view of a struck animal 104 with sending unit 102 lodged in wound 112, with struck animal 104, wound 112, and arrow 114 depicted in phantom.

Reference will now be made in detail to several embodiments of the invention that are illustrated in accompanying drawings. Whenever possible, the same or similar reference numerals are used in the drawings and the description to refer to the same or like parts or steps. The drawing's are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

The tracking device of this invention has a sending unit and a receiving unit. The sending unit is attached to the arrow and has barbs that allow it to remain with the animal even if the arrow completely traverses the body. The sending unit sends a signal which is received by the receiving unit. Thus, if the sending unit did not detach from the arrow and remain with the body, the receiving unit would not lead the hunter to the struck or down animal.

The sending unit of this tracking device is small in size and weight. Thus, the sending unit does not cause great interference with the trajectory of the arrow. The sending unit, with its housing, is preferably between 1.27 centimeters (0.5 inches) to 5.08 centimeters (2.0 inches) in length by 0.64 centimeters (0.25 inches) to 2.54 centimeters (1 inch) in width and 2.0 grams (0.0044 pounds) to 3.0 grams (0.0066 pounds) in weight. More preferably, the sending unit is between 1.91 centimeters (0.75 inches) to 3.81 centimeters (1.5 inches) in length by 1.27 centimeters (0.5 inch) to 1.91 centimeters (0.75 inch) in width and 2.25° grams (0.0050 pounds) to 2.8 grams (0.0062 pounds) in weight. Most preferably, the sending unit is between 2.29 centimeters (0.9 inches) to 3.18 centimeters (1.25 inches) in length by 1.52 centimeters (0.6 inch) to 1.78 centimeters (0.7 inches) in width and 2.5 grams (0.0055 pounds) to 2.75 grams (0.0061 pounds) in weight.

The tracking device of this invention uses radio frequency identification technology (hereinafter "RFID") which provides great versatility and flexibility. Due to the RFD technology, the receiving unit can read information from the sending unit even through objects. Thus, if the sending unit is lodged in the body of an animal, the receiving unit can still receive signals and track the animal. The sending unit does not have to be in the line of sight of the receiving unit for the tracking device to function.

The receiving unit is also small in size so that it is easily transported and utilized by the hunter. In the preferred embodiment, the receiving unit is less than 22.86 centimeters (9 inches) in length and 15.24 centimeters (6 inches) in width.

Figure 2:
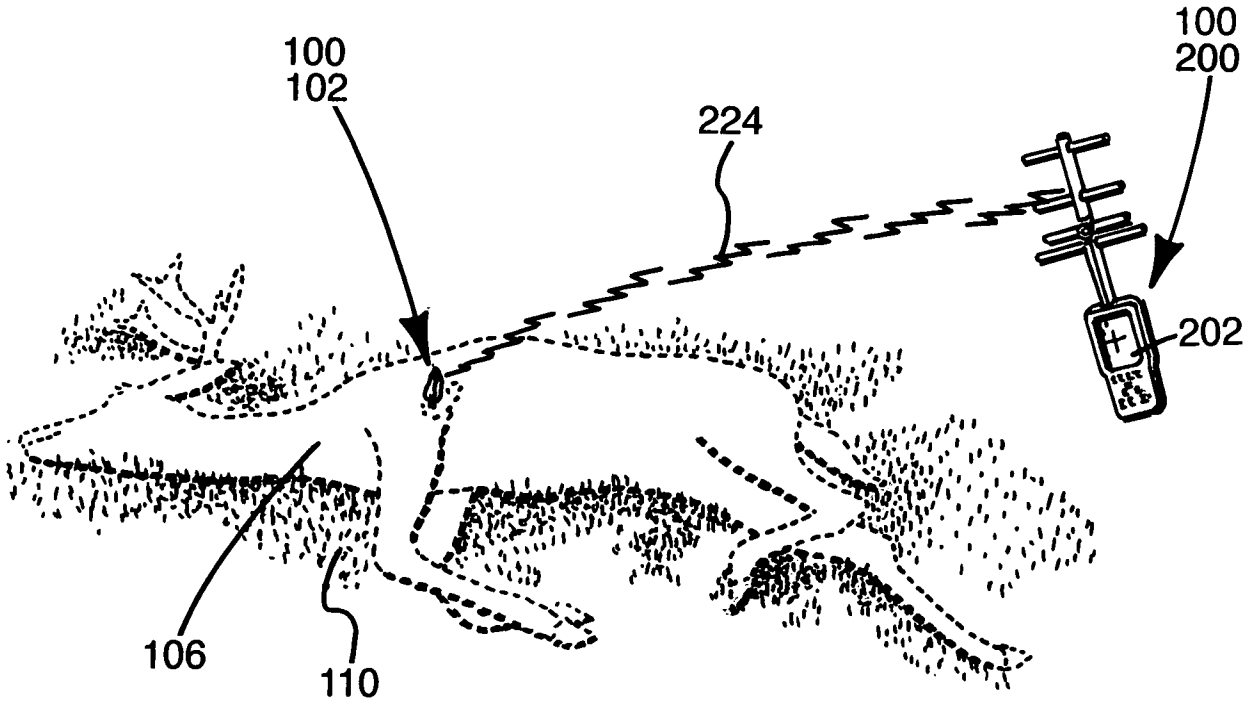
FIG. 2 depicts a top, perspective view of down animal 106 with arrow 114 absent and the sending unit 102 transmitting the signal 224 to receiving unit 200, with down animal 106 depicted in phantom.
Figure 3:
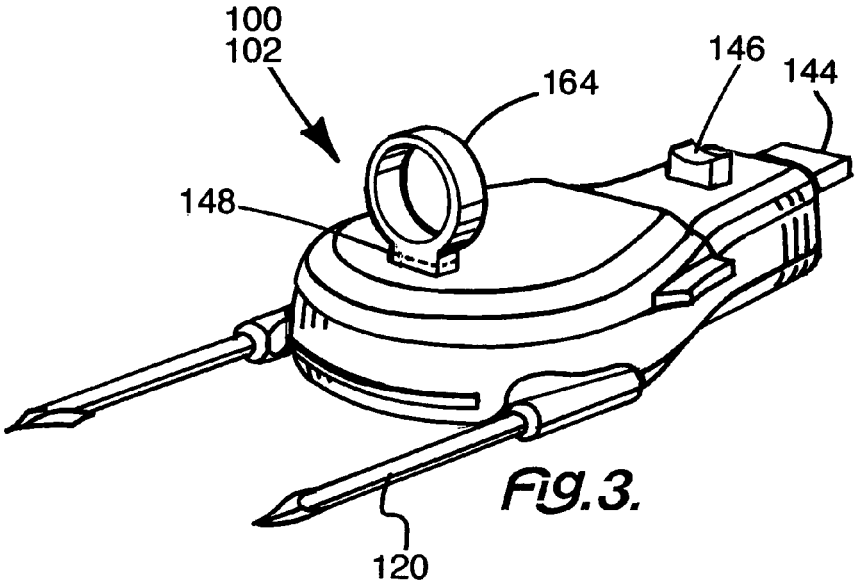
FIG. 3 depicts a top, frontal perspective view of sending unit 102 of tracking device 100.
Figure 4:
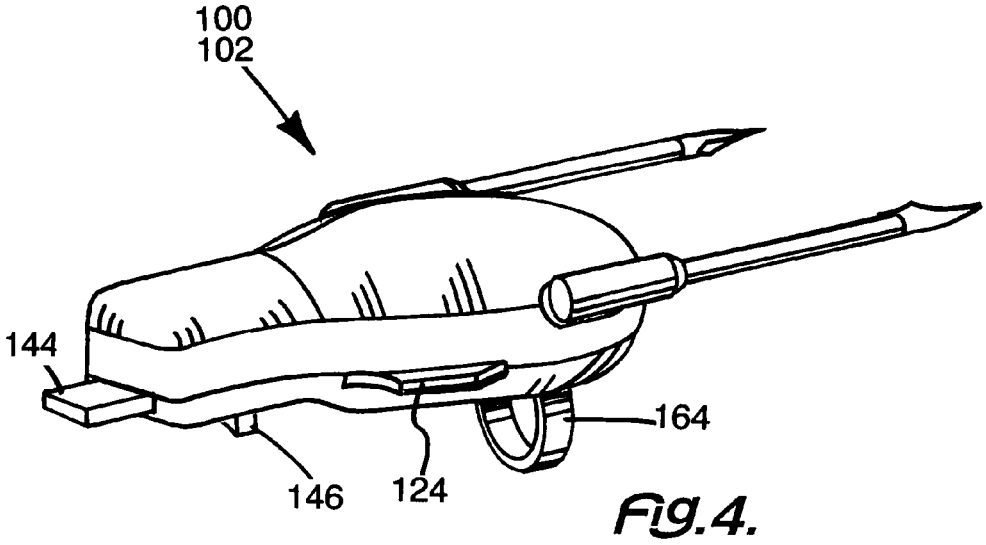
FIG. 4 depicts a rear, bottom perspective view of sending unit 102 of tracking device 100.
Figure 5:
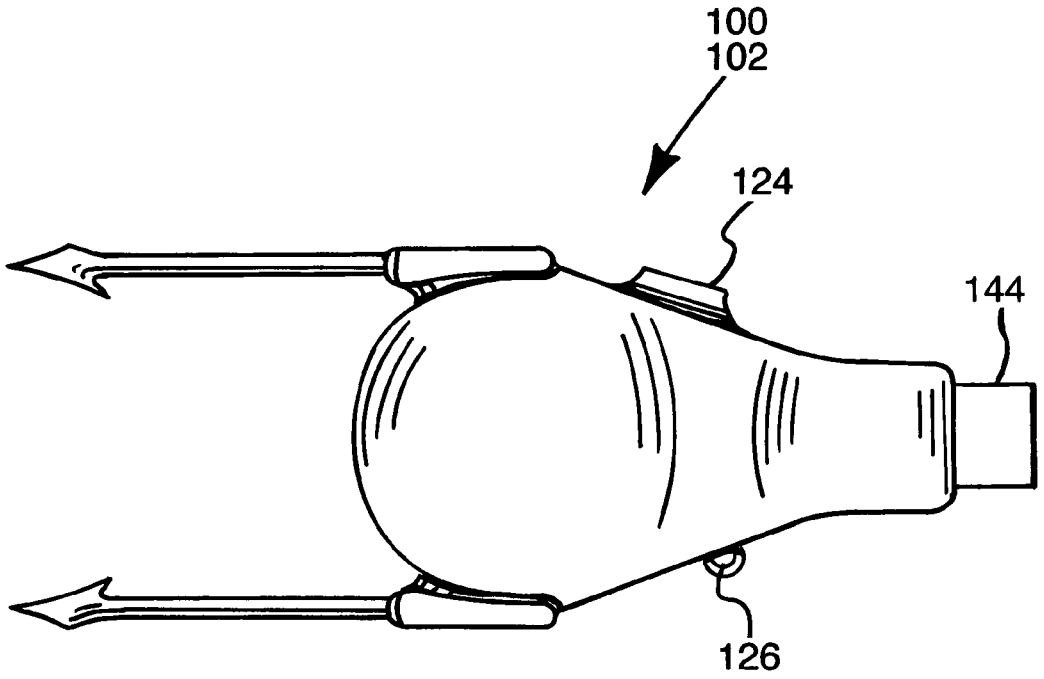
FIG. 5 depicts a bottom plan view of sending unit 102 of tracking device 100.
Figure 6:
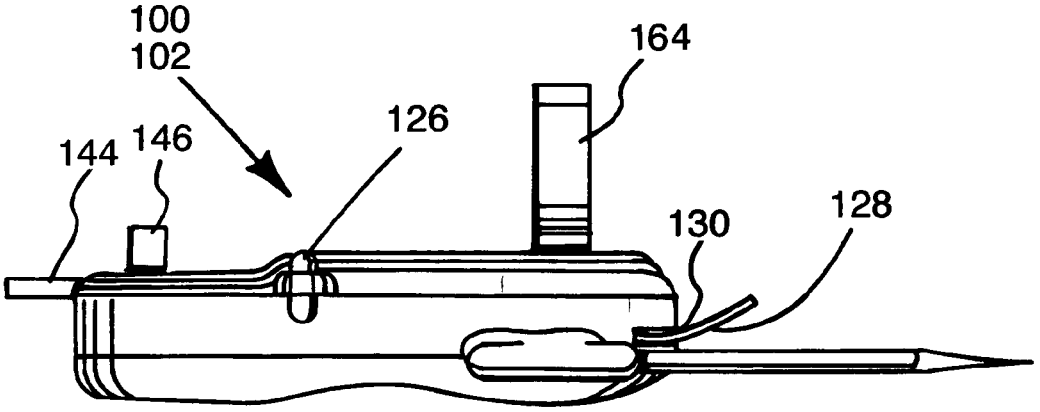
FIG. 6 depicts a side plan view of sending unit 102 of tracking device 100.

Now adding FIG. 1 and FIG. 2 to the consideration, the structure of tracking device 100 can be clearly seen. FIG. 1 depicts struck animal 104 still running while FIG. 2 depicts down animal 106. Tracking device 100 has sending unit 102 which is attached to arrow 114. Sending unit 102 is a transmitter or tag and these terms are used interchangeable throughout this disclosure. As arrow 114 enters struck animal 104, it creates wound 112 and sending unit 102 attaches to struck animal 104 through barbs 120. Sending unit 102 stays with struck animal 104 regardless of the amount of ground 110 traversed before becoming down animal 106. Barbs 120 allow sending unit 102 to stick and stay with animal 104 or 106.

Sending unit 102 generates and receives signals 224 from receiving unit 200. Receiving unit 200 generates and receives signals 224 from sending unit 102. RFID technology is used to send and receive signals 224. Since RFID technology is used to send and receive signals 224, signals 224 can be read even if sending unit 102 is implanted in down animal 106 or has other environmental factors blocking a direct path between sending unit 102 and receiving unit 200. RFID technology allows the sending unit 102 and the receiving unit 200 to communicate.

Sending unit 102 is small in size relative to arrow 114. This allows sending unit 102 to cause minimal interference with the trajectory of arrow 114, as arrow 114 is loosed or shot from a bow (not shown).

Barbs 120 extend from sending unit 102. Barbs 120 allow the sending unit 102 to remain with the struck or down animal 104 or 106 even if the arrow 114 traverses the entire body. However, barbs 120 do not interfere with the penetration or movement of the arrow 114 through the struck animal 104.

Now adding FIG. 3, FIG. 4, FIG. 5, FIG. 6, FIG. 7, FIG. 7*a*, FIG. 7*b*, FIG. 7*c*, FIG. 7*d*, FIG. 8, and FIG. 9 to the consideration, the structure and function of sending unit 102 can be clearly seen. Housing 156 has housing base 152 and housing lid 150 connected through hinge 124 and secured through a releasable fastening device such as snap clasp 126. Snap clasp 126 allows housing 156 to be readily opened and dosed.

Housing 156 can be made of any suitable material but the preferred material is plastic. Housing 156 protects the tag battery 136 and the tag circuit board 142 from the shock of impact with struck animal 104 and environmental conditions such as rain. Housing 156 thus protects the power source such as tag battery 136 and a transmitting device such as tag circuit board 142 and thus, the internal components can be reused by changing housing 156. Likewise, tag battery 136 and tag circuit board 142 can be used in different housing 156.

Tag battery 136 can be readily removed through battery pull strip 128 which is housed in battery pull strip gate 130. The removal of tag battery 136 provides great advantage to tracking device 100 as tag battery 136 can be replaced while the prior art requires a completely new sending unit 102.

Housing base 152 has barb cradles 118. Barbs 120 insert into barb cradles 118. Barb cradles 118 secure barbs 120 to housing base 152.

Tag circuit board 142 has tag antenna 144. Tag antenna 144 communicates with receiving unit antenna 222 of receiving unit 200 through RFID technology (See FIG. 11). Tag antenna 144 is small and unobtrusive so that it does not interfere with the trajectory of arrow 114 when released or loosed from the bow. Since RFID technology is used, tag antenna 144 can transmit signals 224 to receiving unit antenna 222 even if sending unit 102 is lodged in struck or down animal 104 or 106 such as in FIG. 7*c*.

Tag circuit board 142 has a unique identification 294 which is trackable by the receiving unit 200 through RFID technology. In the preferred embodiment, the unique identification is a memory bar code. Memory bar code 294 has a set of unique numbers associated with it. However, any method of identification of the sending unit 102 by the receiving unit 200 is acceptable and encompassed by this disclosure.

Referring specifically to FIG. 3, FIG. 4, FIG. 6, FIG. 7*a*, FIG. 7*b*, FIG. 7*c*, and FIG. 7*d*, the connection between sending unit 102 and arrow 114 can be clearly seen. Arrow 114 has arrow shaft 140 and arrowhead 138 and sometimes a broad head 116 is used. However, the sending unit 102 can be utilized with any type of arrowhead 138. Arrowhead 138 is detachable from arrow shaft 140.

The arrowhead 138 or broad head 116 has a base with male threads 160 while arrow shaft 140 has female threads 162. The base of broad head 116 inserts into mount collar 164 and then into arrow shaft 140 and the connection is secured through the cooperation and connection of male threads 160 and female threads 162. Mount collar 164 is secured to the top of housing 156 through break away seam 148. Break away seam 148 will break away and release the connection between sending unit 102 and arrow 114 when barbs 120 penetrate struck or down animal 104 or 106. Thus, a stable and releasable connection between sending unit 102 and arrow 114 is formed and there is no interference with the trajectory of arrow 114 once it is loosed from the bow. Arrow shaft 140 rests against mount rest 146 which is also secured to the top of housing 156.

Figure 8:
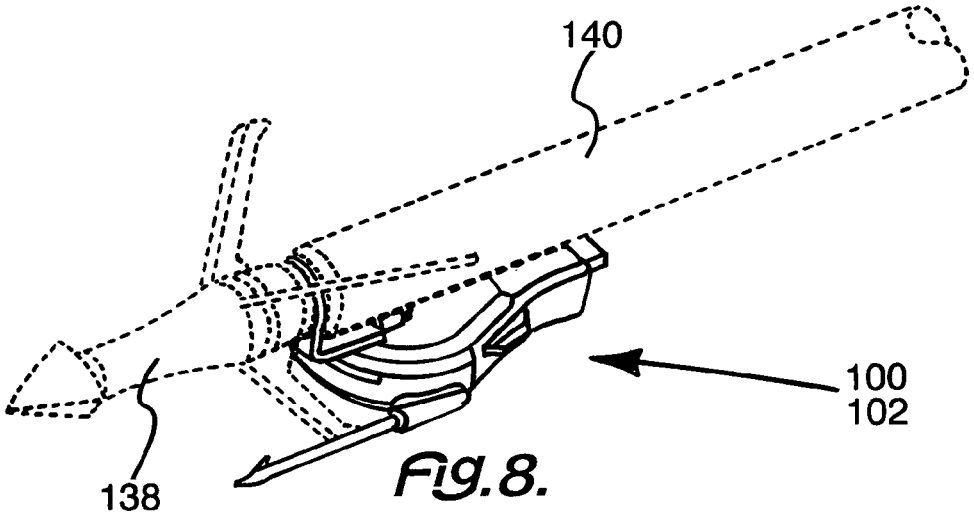
FIG. 8 depicts a top, perspective view of sending unit 102 mounted on arrow 114, with arrowhead 138 and arrow shaft 140 depicted in phantom.
Figure 9:
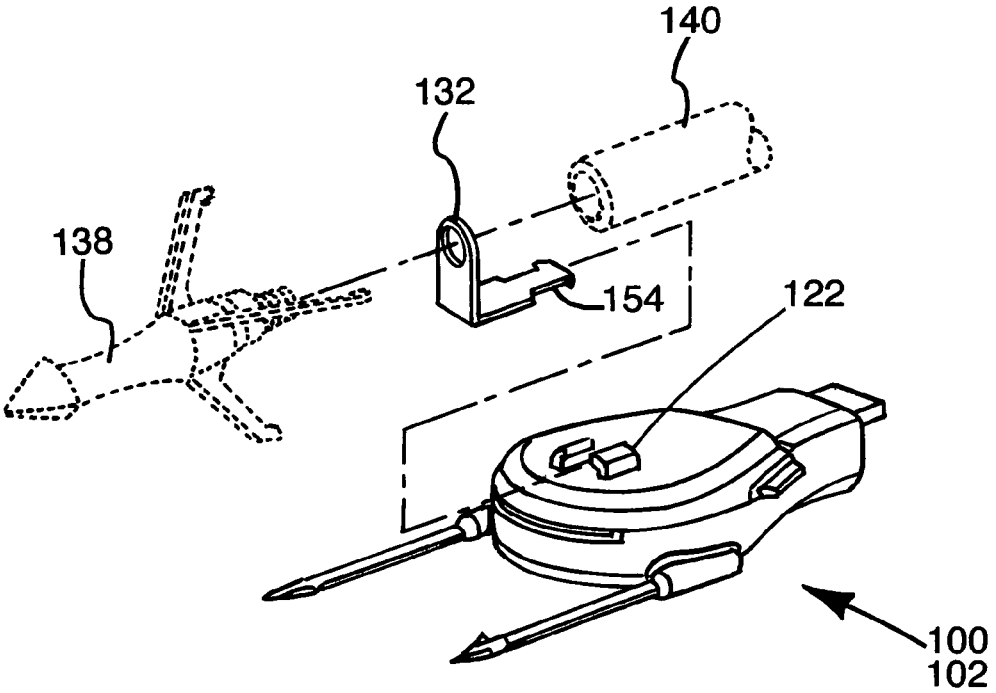
FIG. 9 depicts an exploded, top perspective view of mounting clip 132 and the relationship between it, arrowhead 138, arrow shaft 140, and sending unit 102, with arrowhead 138 and arrow shaft 140 depicted in phantom.

Referring specifically to FIG. 8 and FIG. 9, an alternative connection between sending unit 102 and arrow 114 can be clearly seen. Sending unit 102 has clip gripper 122 on housing lid 150. Mounting clip 132 attaches below arrow shaft 140 and on arrowhead 138 and is secured between the two components. On the bottom of mounting clip 132 is snap mount 154. Clip gripper 122 cooperates with snap mount 154 to create a secure and releasable connection between sending unit 102 and arrow 114. Thus, sending unit 102 is securely connected to arrow 114, yet does not interfere with the trajectory of arrow 114 once it is released or loosed from the bow.

Clip gripper 122 forms a releasable connection with snap mount 154. As arrow 114 travels through, and possibly or eventually out of struck animal 104, clip gripper 122 releases snap mount 154, thereby leaving sending unit 102 with the struck animal 104. Thus, sending unit 102 is able to release from arrow 114 and remain in struck animal 104 with the aid of barb 120.

The unique attachment means between the mount collar 164, break away seam 148, housing 156, and arrow 114 or clip gripper 122, snap mount 154 and arrow 114, allows the tracking device 100 to have great versatility and flexibility. The mount collar 164 or snap mount 154 attaches behind the arrowhead 138 or broad head 116. This connection allows the tracking device 100 to cooperate with any type of arrowhead 138 whether it is a conventional, fixed-blade, or a mechanical broad head. The attachment means allow the tracking device 100 to work with all arrow rests. Thus any type of bow may be utilized with the tracking device 100 of this invention. Also, either of these attachment means minimize flight interference of the arrow 114.

Sending unit 102 has a variety of components to aid the hunter. Sending unit 102 has tag circuit board 142 (See FIG. 19), a tag battery section circuitry 264 (See FIG. 20), tag controller 284 (See FIG. 31), and amplifier 304 (See FIG. 34). In the preferred embodiment, the sending unit 102 has all of these components. However, any combination of these components is acceptable and is encompassed by this disclosure.

Figure 10:
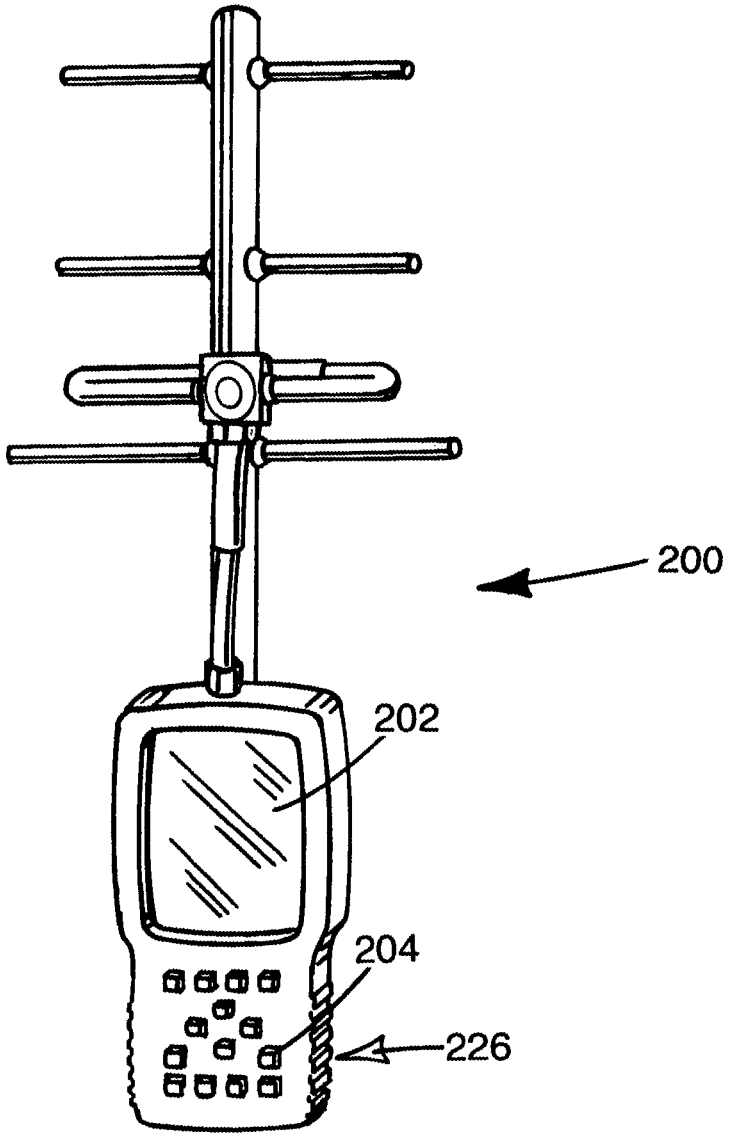
FIG. 10 depicts a front plan view of receiving unit 200.
Figure 11:
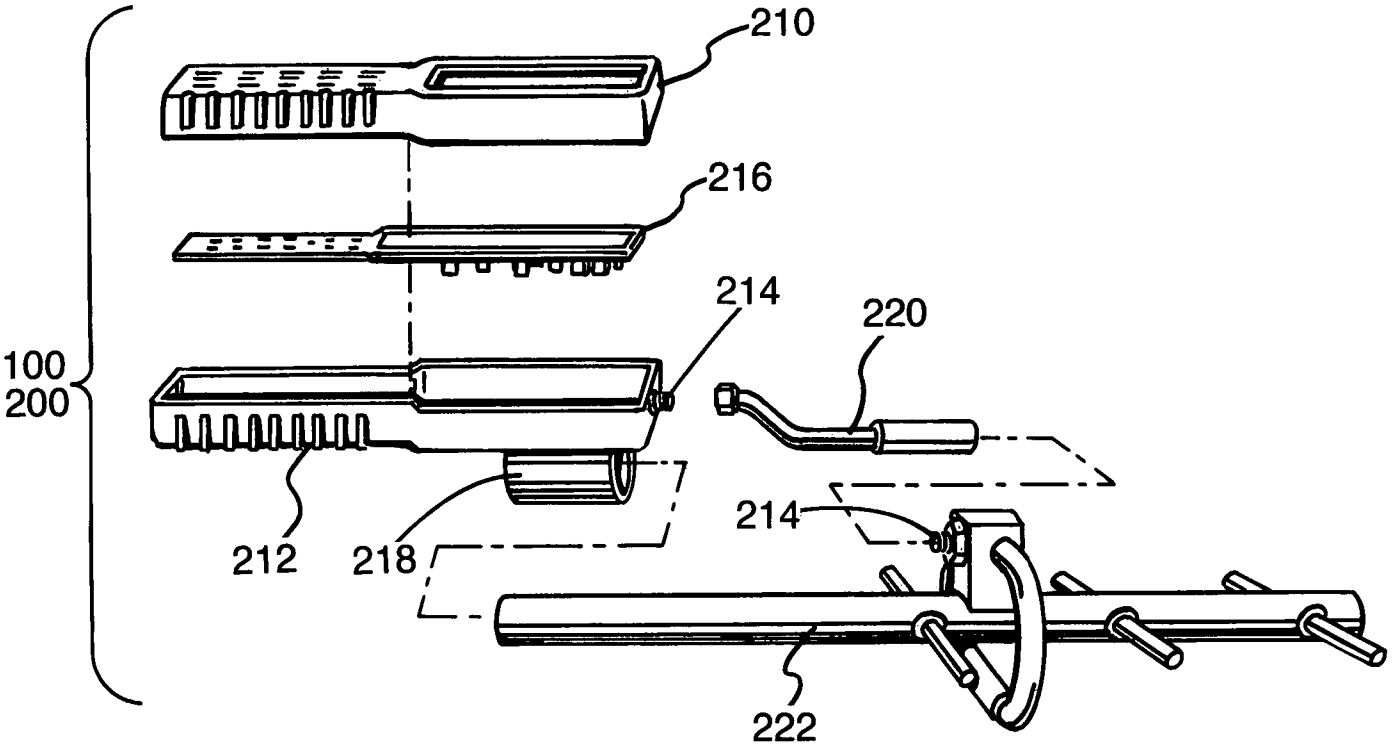
FIG. 11 depicts an exploded perspective view of receiving unit 200.
Figure 12:
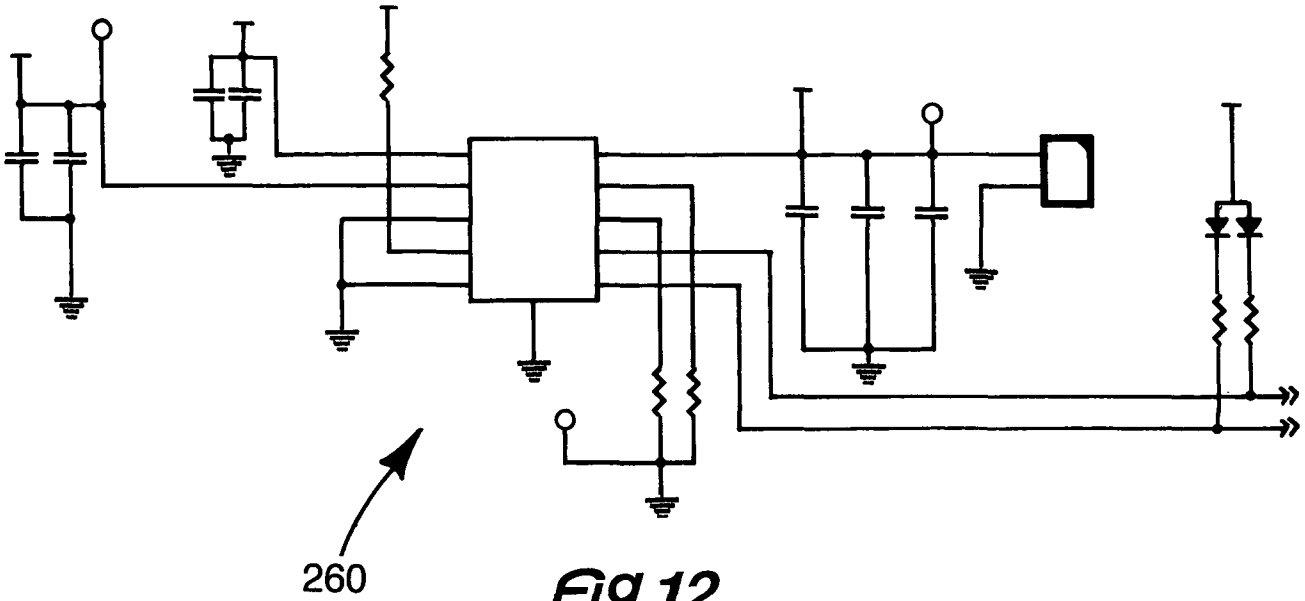
FIG. 12 depicts a schematic diagram of a battery charger circuit 260 of receiving unit 200.
Figure 13:
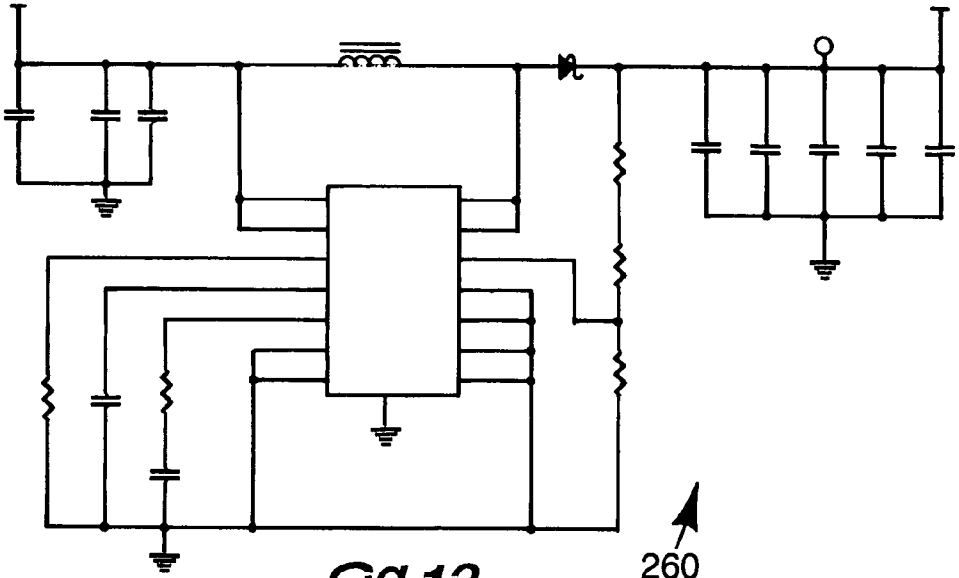
FIG. 13 depicts a schematic diagram of 5 voltage regulator 278 of battery charger circuit 260 of receiving unit 200.

Now adding FIG. 10 and FIG. 11 to the consideration, the structure of receiving unit 200 can be clearly seen. Receiving unit 200 is small and compact and is easily transported and utilized. Receiving unit 200 is a receiver and these terms are used interchangeably throughout this disclosure.

Receiving unit 200 has receiving unit base 212 and receiving unit cover 210 which form the outer housing. Receiving unit circuit board 216 is housed between the receiving unit base 212 and the receiving unit cover 210 and is protected from the external environment.

Receiving unit base 212 has threaded screw 214 which cooperates with coaxial cable 220 to secure it to receiving unit 200. Receiving unit antenna 222 also has a threaded screw 214 to attach to coaxial cable 220. Also, receiving unit base 212 has antenna cradle 218. Receiving unit antenna 222 inserts into antenna cradle 218 and is thusly secured to receiving unit 200.

Receiving unit 200 has a multitude of components to aid in retrieving sending unit 102. Receiving unit 200 preferably has a battery charger circuit 260 which cooperates with receiving unit battery 262 (See FIG. 12, FIG. 13, FIG. 14, FIG. 15, FIG. 16, FIG. 17, and FIG. 18). Also, receiving unit 200 has an on/off circuit 270 (See FIG. 21, FIG. 22, FIG. 23, and FIG. 24) which is powered by receiving unit battery 262. Controller 244 (See FIG. 25, FIG. 26, FIG. 27, and FIG. 28) sends and receives information and signals 224 between the sending unit 102 and other sections of the receiving unit 200.

Figure 29:
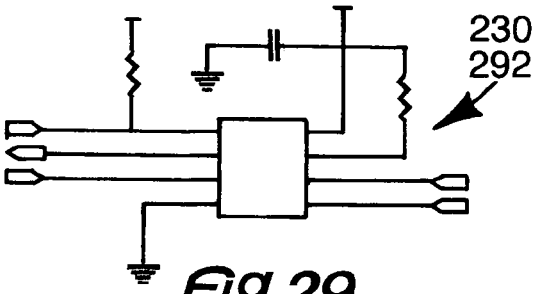
FIG. 29 depicts a schematic diagram of the memory bar code circuit 292 of receiving unit 200.
Figure 30:
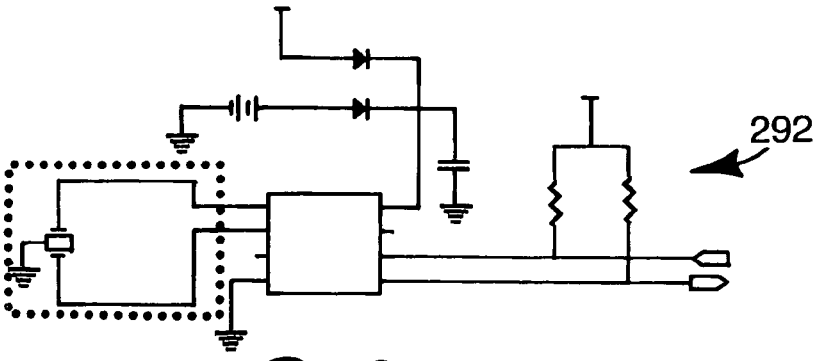
FIG. 30 depicts a schematic diagram of the memory bar code circuit 292 of the receiving unit 200.

Furthermore, receiving unit 200 has a memory bar code circuit 292 to aid in finding a specific sending unit 102 in an area where more than one sending unit 102 is present (See FIG. 29 and FIG. 30). A digital compass 250 directs the hunter to the location of sending unit 102 (See FIG. 32 and FIG. 33). A keypad section 238 allows the hunter to input information into receiving unit 200 (See FIG. 35). A display section 248 communicates information received from sending unit 102 to the hunter in either visual or audio form (See FIG. 36, FIG. 37, FIG. 38, FIG. 39, FIG. 40, and FIG. 41).

It is preferable that all of these components are present in receiving unit 200. However, any combination of the components is acceptable and encompassed by this disclosure.

Now referring to FIG. 12, FIG. 13, FIG. 14, FIG. 15, FIG. 16, FIG. 17, and FIG. 18, the structure and function of battery charger circuit 260, contained within receiving unit 200, can be clearly seen. These Figures are meant to illustrate a potential battery charger circuit 260 that can be used with the tracking device 100 of this invention. This example is meant for illustrative purposes and is in no way presented to limit the scope of the possibilities for battery charger circuit 260. Any battery charger circuit 260 which can be properly connected and utilized to charge receiving unit battery 262 in receiving unit 200 is acceptable and encompassed by this disclosure.

Figure 14:
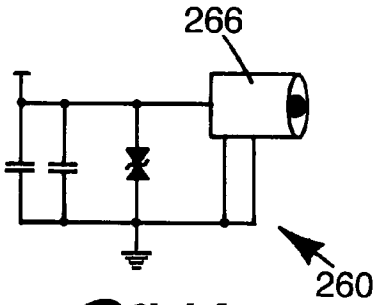
FIG. 14 depicts a schematic, diagram of power jack 266 of battery charger circuit 260 of receiving unit 200.
Figure 15:
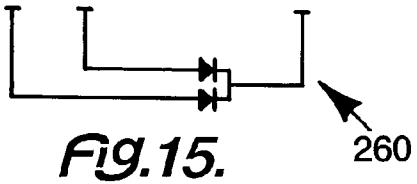
FIG. 15 depicts a schematic diagram of battery charger circuit 260 of receiving unit 200.
Figure 16:
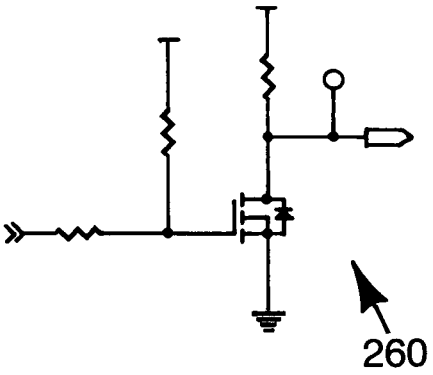
FIG. 16 depicts a schematic diagram of battery charger circuit 260 of receiving unit 200.
Figure 17:
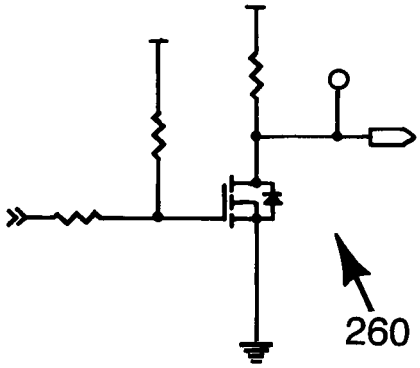
FIG. 17 depicts a schematic diagram of battery charger circuit 260 of receiving unit 200.
Figure 18:
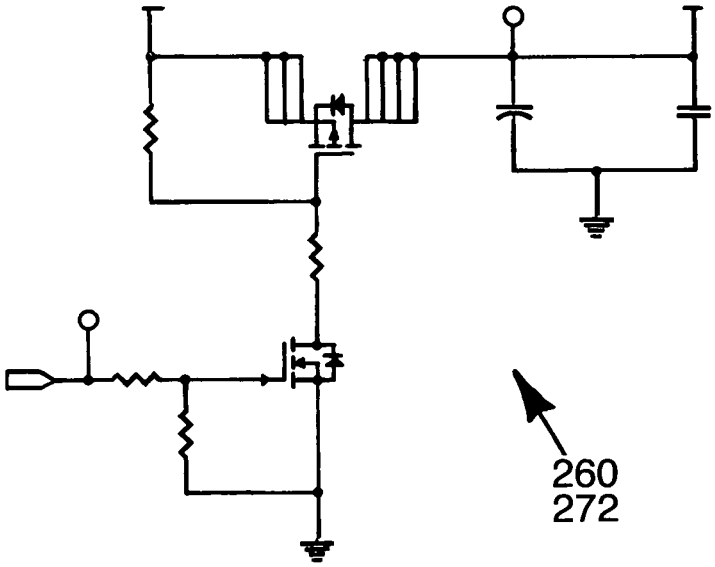
FIG. 18 depicts a schematic diagram of battery switching circuit 272 of battery charger circuit 260 of receiving unit 200.
Figure 44:
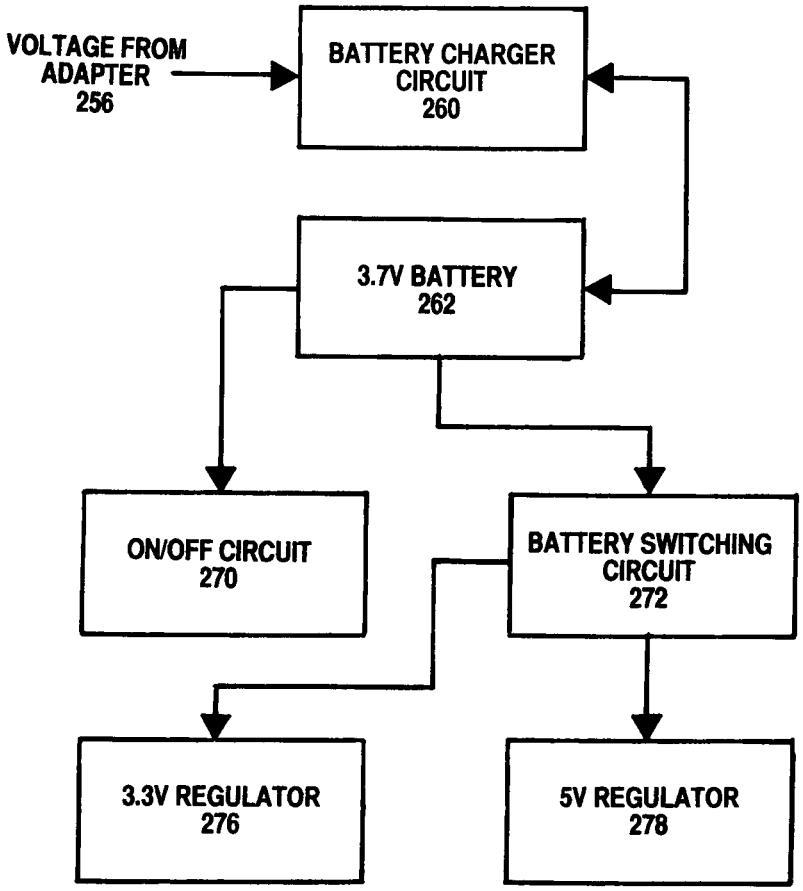
FIG. 44 depicts a block diagram of the power supply of the receiving unit 200 of this invention.

Battery charger circuit 260 has circuitry which includes a 5 voltage regulator 278 (FIG. 13) and a power jack 266 (FIG. 14). Receiving unit 200 has the necessary circuitry to accommodate 5 voltage regulator 278 (See FIG. 44). Battery charger circuit 260 may also have a battery switching circuit 272 to alternate the power supply between 5 voltage regulator 278, 3.3 voltage regulator 276, and any other voltage regulators that may be present (FIG. 18 and FIG. 44).

Now adding FIG. 19, FIG. 20, FIG. 31, and FIG. 34 to the consideration, the structure and function of sending unit 102 can be clearly seen. The structure and function of tag circuit board circuitry 282 and tag controller 284 is clearly depicted. Again these Figures are meant to illustrate a potential tag circuit board circuitry 282 and tag controller 284 that can be used with tracking device 100 and is in no way meant to limit the scope of this disclosure. Any suitable tag circuit board circuitry 282 and tag controller 284 which can be properly connected and utilized with this invention is encompassed by this disclosure.

Figure 19:
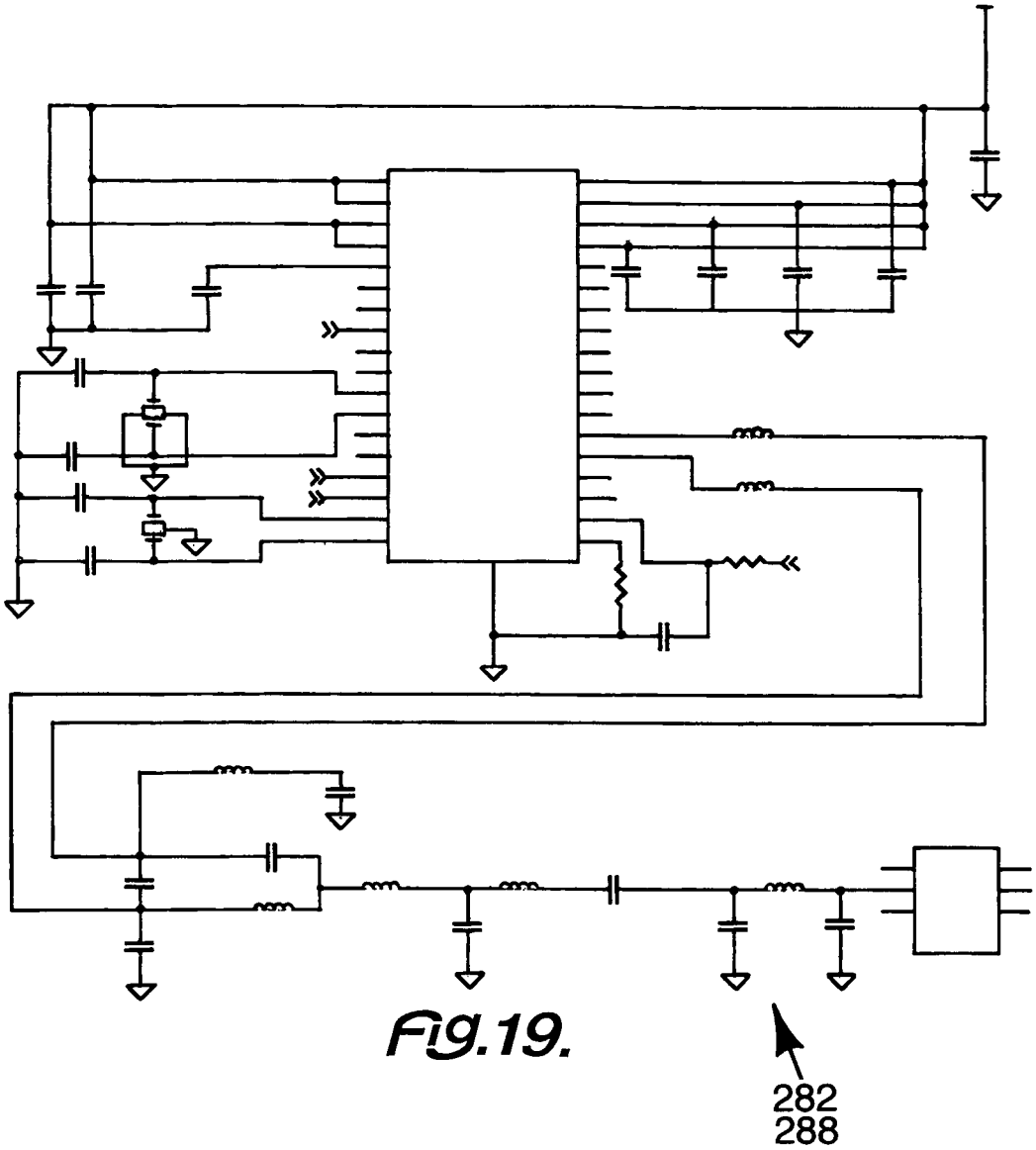
FIG. 19 depicts a schematic diagram of tag circuit board 142 with antenna matching circuit 288 of sending unit 102.
Figure 20:
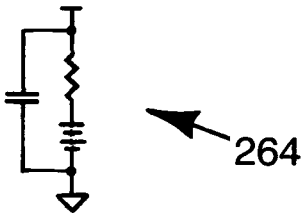
FIG. 20 depicts a schematic diagram of the tag battery section circuitry 264 of the sending unit 102.

Referring specifically to FIG. 19 and FIG. 20, tag circuit board circuitry 282 has tag battery section circuitry 264 to receive power from the tag battery 136. Thus, tag battery 136 is able to properly power sending unit 102. Also, tag circuit board circuitry 282 has antenna matching circuit 288 (See FIG. 19 and FIG. 43).

Figure 31:
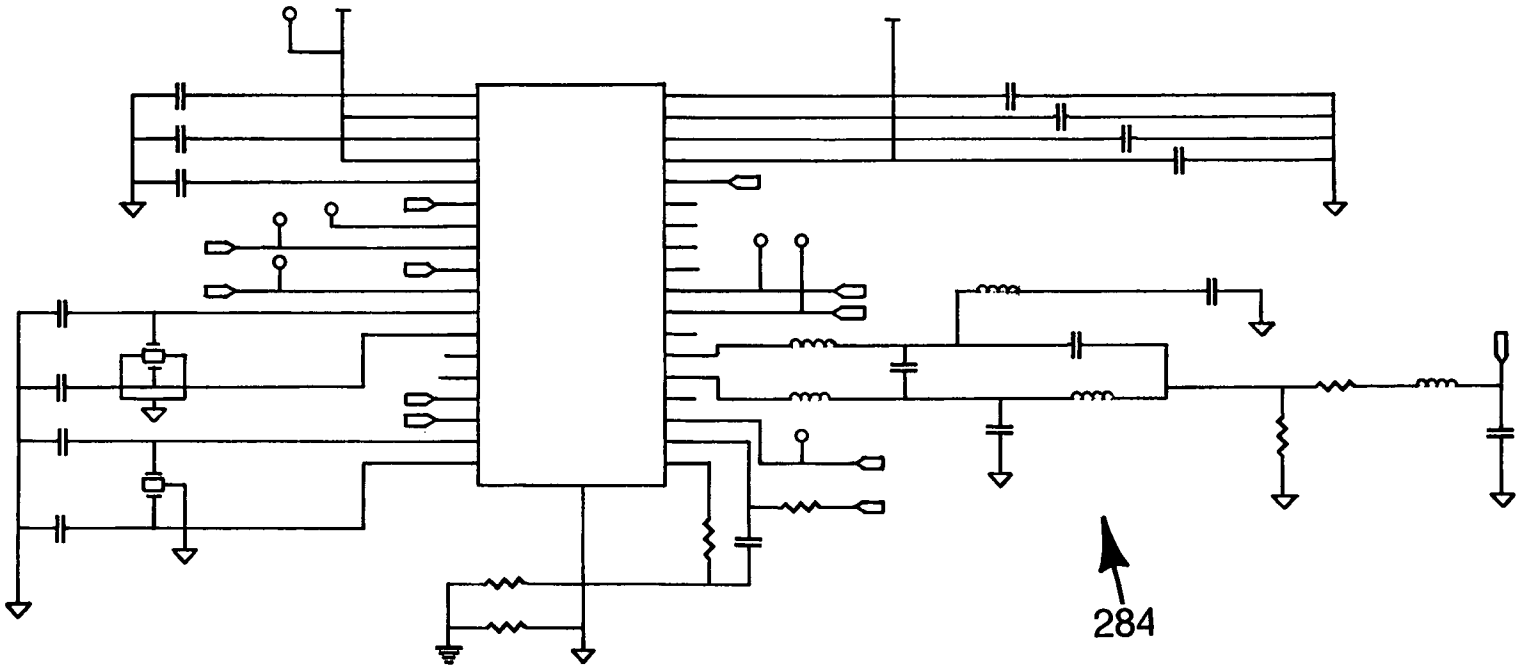
FIG. 31 depicts a schematic diagram of tag controller 284 of sending unit 102.

Referring specifically to FIG. 31, the structure and function of tag controller 284 of sending unit 102 can be clearly seen. Tag controller 284 processes, sends, and receives information from receiving unit 200 through RFID technology. Tag controller 284 also stores the unique identification 294 of sending unit 102 which is read by receiving unit 200 (See FIG. 7).

Figure 34:
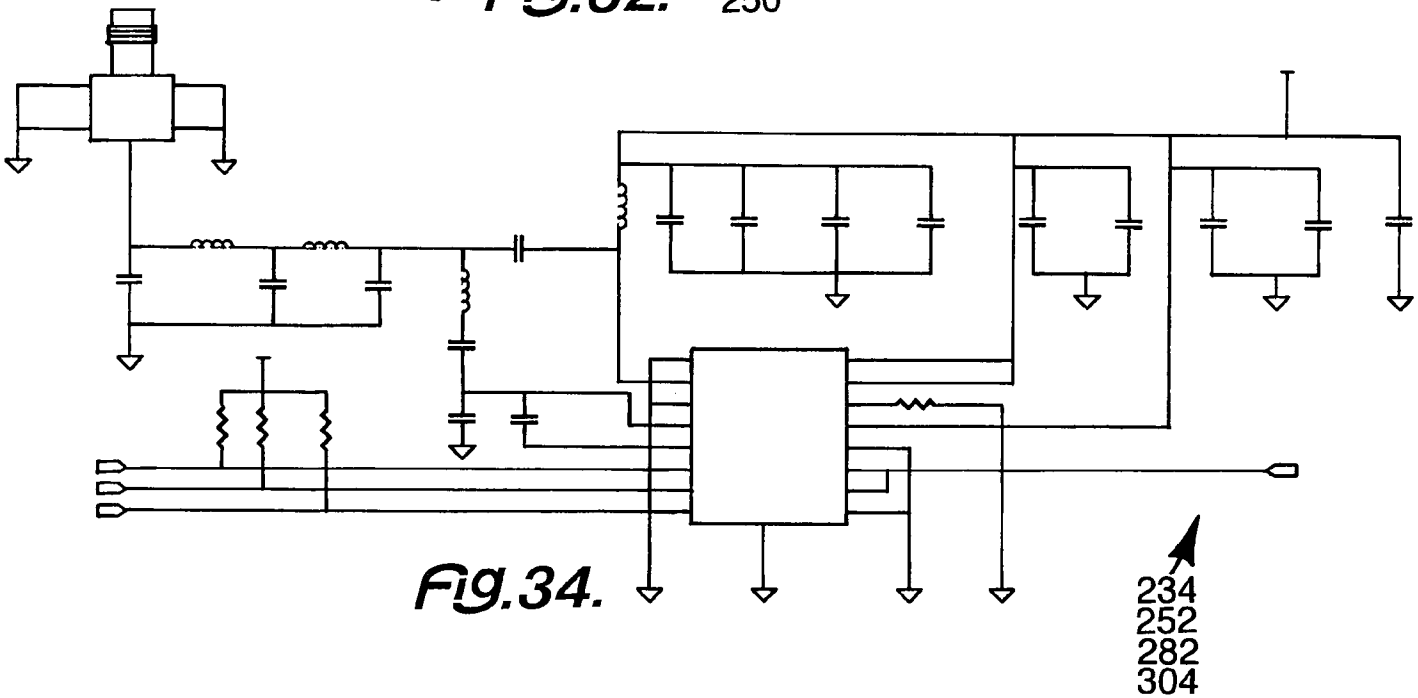
FIG. 34 depicts a schematic diagram of the amplifier 304 on tag circuit board 142 of the sending unit 102.

Referring specifically to FIG. 34, the structure and function of amplifier 304 on tag circuit board circuitry 282 can be clearly seen. Amplifier 304 increases the strength of signal 224 sent to receiving unit 200. This provides the tracking device 100 with great benefits as the sending unit 102 can be a greater distance from the receiving unit 200 and still be tracked through RFID technology. Also, communication section 234 and animal tracking receiver 252 are depicted (See FIG. 42).

Figure 23:
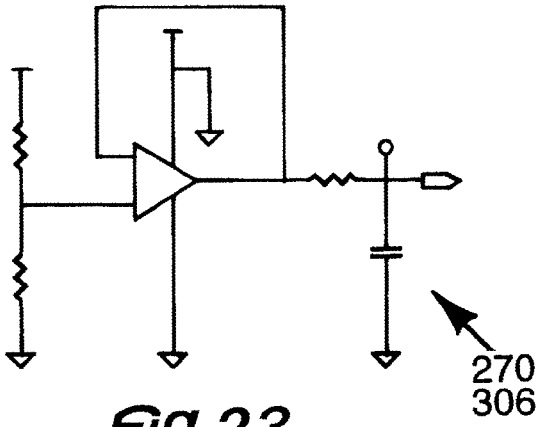
FIG. 23 depicts a schematic diagram of the operational amplifier section 306 of the on/off circuit 270 of receiving unit 200.
Figure 24:
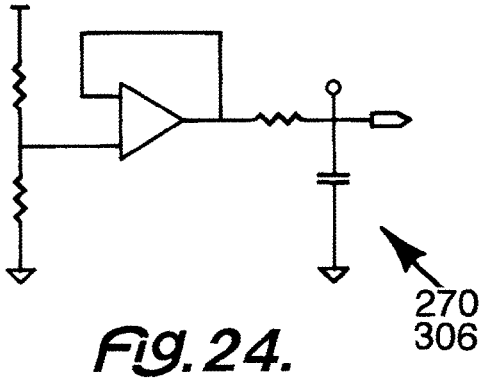
FIG. 24 depicts a schematic diagram of the operational amplifier section 306 of the on/off circuit 2'70 of receiving unit 200.
Figure 25:
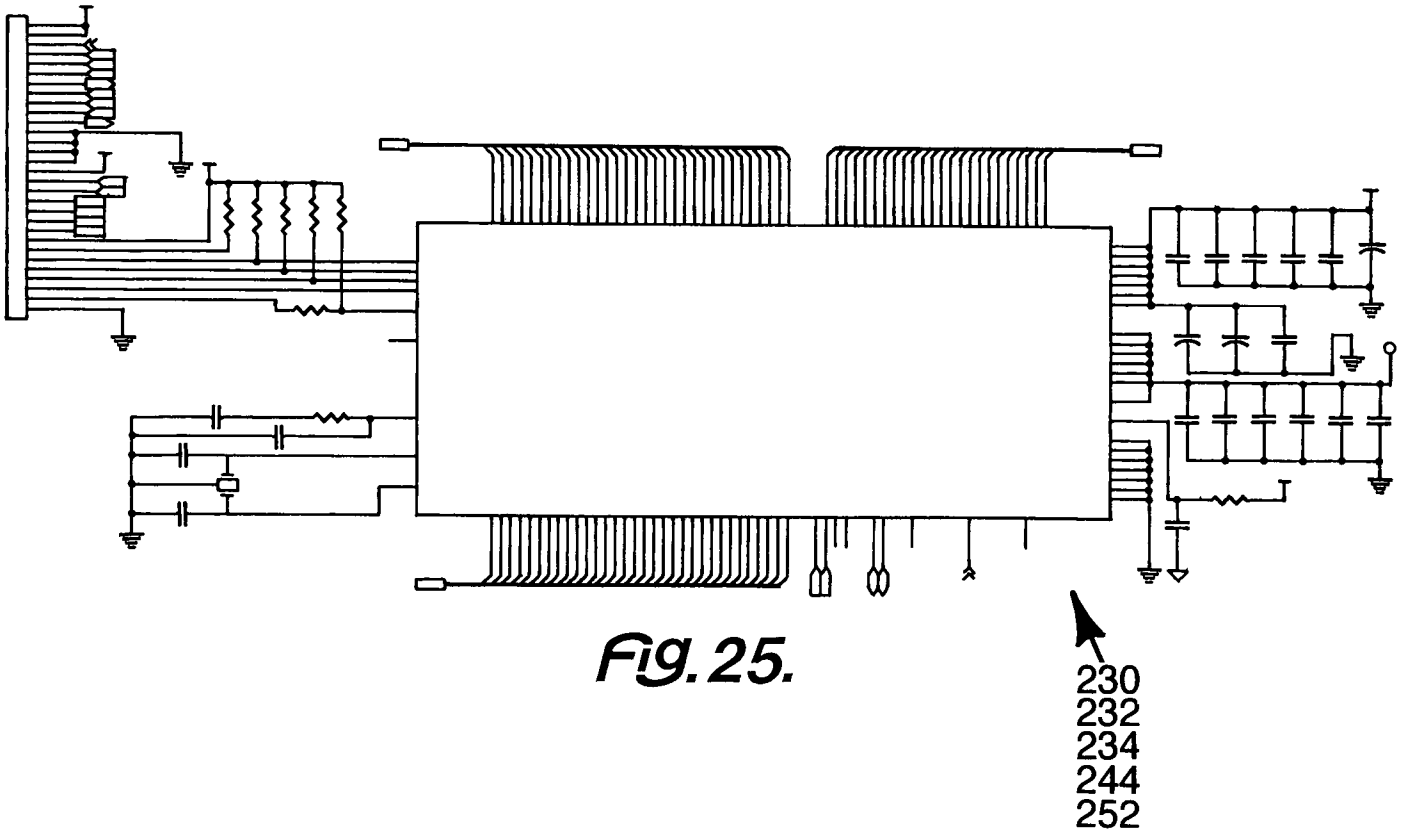
FIG. 25 depicts a schematic diagram of controller 244 of receiving unit 200.
Figure 26:
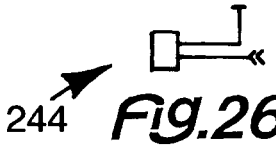
FIG. 26 depicts a schematic diagram of controller 244 of receiving unit 200.
Figure 27:
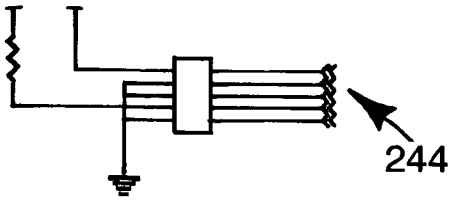
FIG. 27 depicts a schematic diagram of controller 244 of receiving unit 200.
Figure 28:
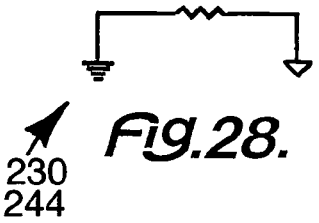
FIG. 28 depicts a schematic diagram of controller 244 of receiving unit 200.

Now ad ding FIG. 21, FIG. 22, FIG. 23, and FIG. 24 to the consideration, the structure and function of on/off circuit 270 of receiving unit 200 can be clearly seen. On/off circuit 270 allows the receiving unit 200 to be turned on while in use and turned off when not in use through button 204 (See FIG. 10). On/off circuit 270 has 3.3 voltage regulator 276 (FIG. 22) and operational amplifier section 306 (FIG. 23 and FIG. 24). Receiving unit 200 has the proper circuitry to allow the 3.3 volt regulator to function properly (See FIG. 18 and FIG. 44).

Again these Figures are meant to illustrate a potential on/off circuit 270 that can be used with tracking device 100 and is in no way meant to limit the scope of this disclosure. Any suitable on/off circuit 270 which can be properly connected and utilized with this invention is encompassed by this disclosure.

Figure 21:
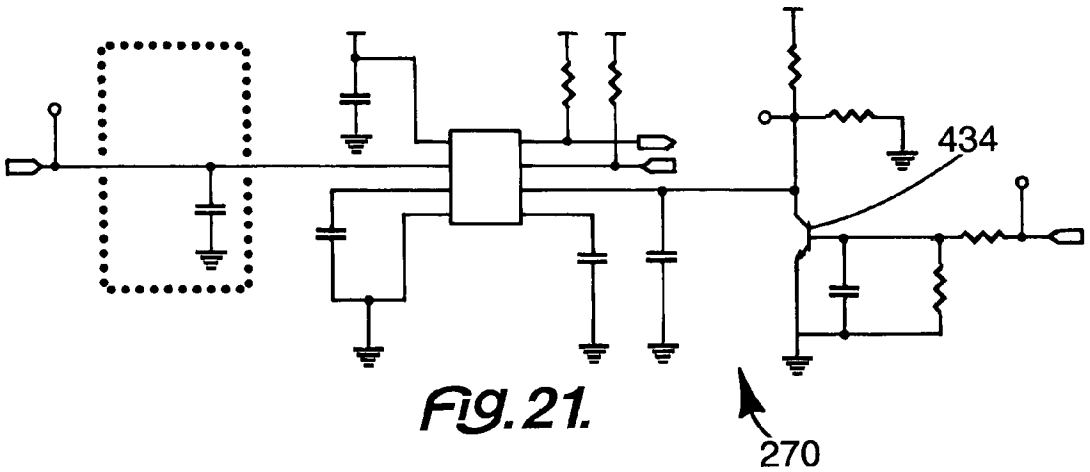
FIG. 21 depicts a schematic diagram of the on/off circuit 270 of receiving unit 200.
Figure 22:
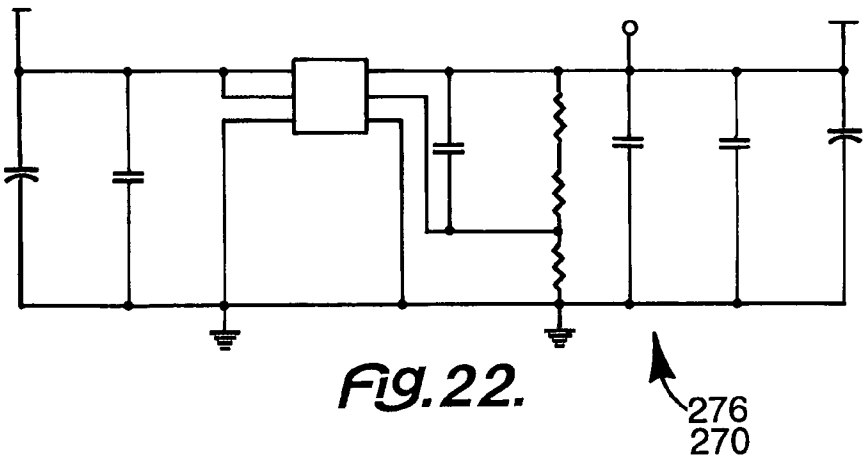
FIG. 22 depicts a schematic diagram of 3.3 voltage regulator 276 of on/off circuit 270 of receiving unit 200.

Referring specifically to FIG. 21, the function of on/off circuit 270 can be clearly seen. On/off circuit 270 has on/off circuit switch 434. On/off circuit switch 434 is opened and closed as the hunter activates and deactivates the receiving unit 200 through button 204.

Figure 42:
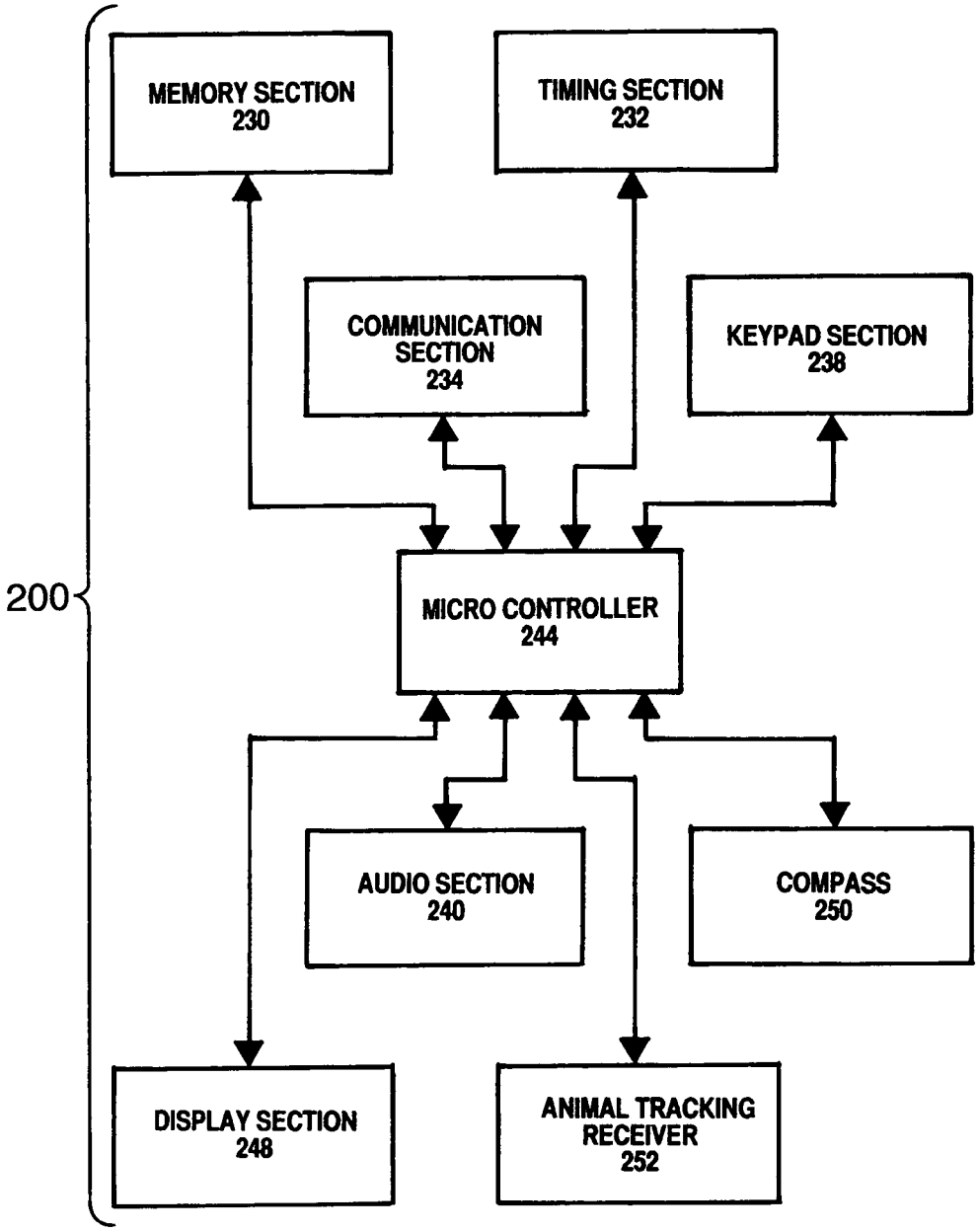
FIG. 42 depicts a block diagram of the receiving unit 200 of this invention.
Figure 43:
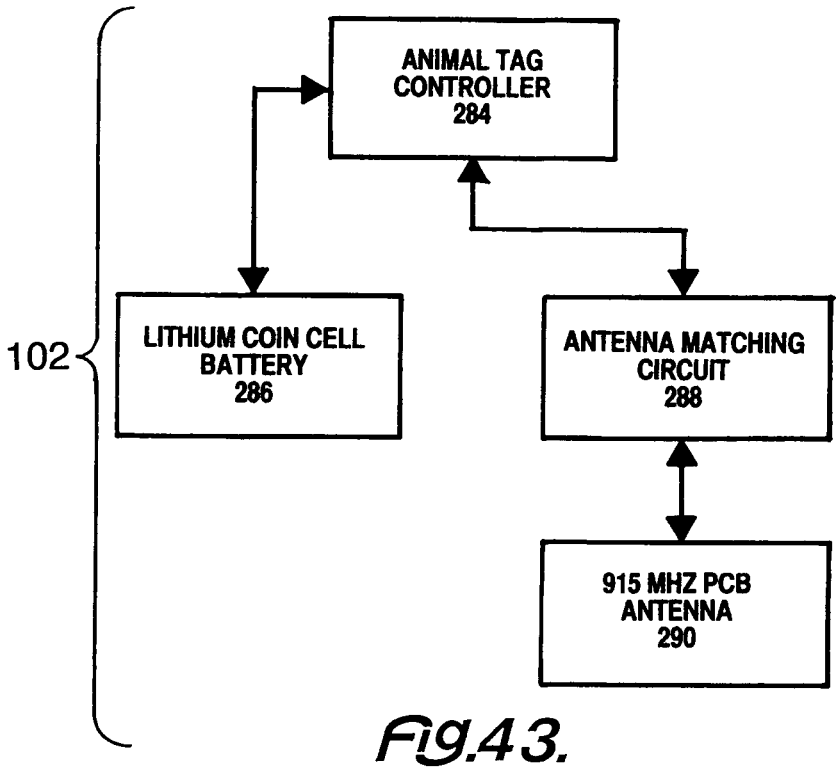
FIG. 43 depicts a block diagram of the sending unit 102 of this invention.

Now adding FIG. 25, FIG. 26, FIG. 27, and FIG. 28 to the consideration the structure of controller 244 on receiving unit 200 can be clearly seen. Controller 244 sends information to and receives information from sending unit 102 through signals 224 and RFID technology. Tag antenna 144 transmits signals 224 to receiving unit antennae 222 on receiving unit 200 (FIG. 42, FIG. 43, and FIG. 44). Controller 244 processes and communicates the information to the hunter. Controller 244 is able to read and store information received through RFID from sending unit 102.

Controller 244 also shows memory section 230, timing section 232, communication section 234, animal tracking receiver 252, and memory bar code circuit 292 (FIG. 42, FIG. 43, and FIG. 44).

Again these Figures are meant to illustrate a potential controller 244 that can be used with tracking device 100 and is in no way meant to limit the scope of this disclosure. Any suitable controller 244 which can be properly connected and utilized with this invention is encompassed by this disclosure.

Now adding FIG. 29 and FIG. 30 to the consideration, the structure and function of memory bar code circuit 292 of receiving unit 200 can be clearly seen. Each tag circuit board 142 has a unique identification 294 (See FIG. 7). Unique identification 294 allows receiving unit 200 to locate a specific sending unit 102 if there is more than one sending unit 102 in the area (See FIG. 7). Receiving unit 200 uses RFID technology to read the unique identification 294 which is associated with tag circuit board 142. In the preferred embodiment, the unique identification 294 is a memory bar code with associated unique numbers. Receiving unit 200 reads memory bar code 294 through RFID technology.

Figure 7:
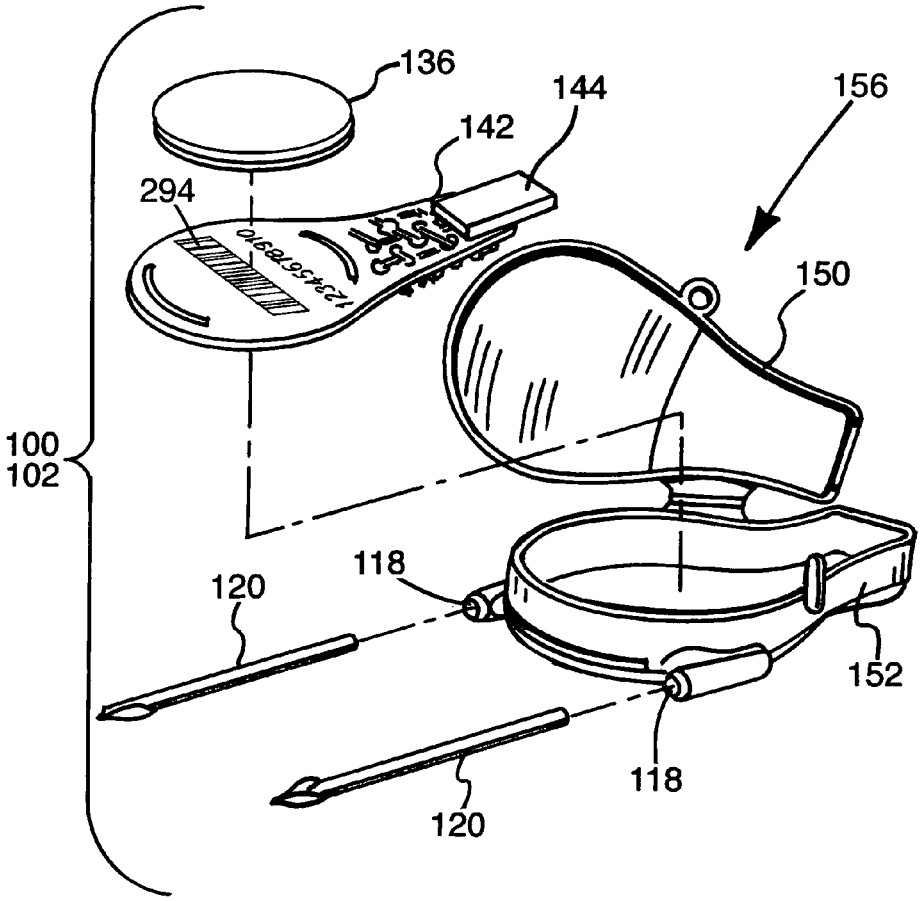
FIG. 7 depicts an exploded perspective view of sending unit 102 of tracking device 100.
Figure 7A:
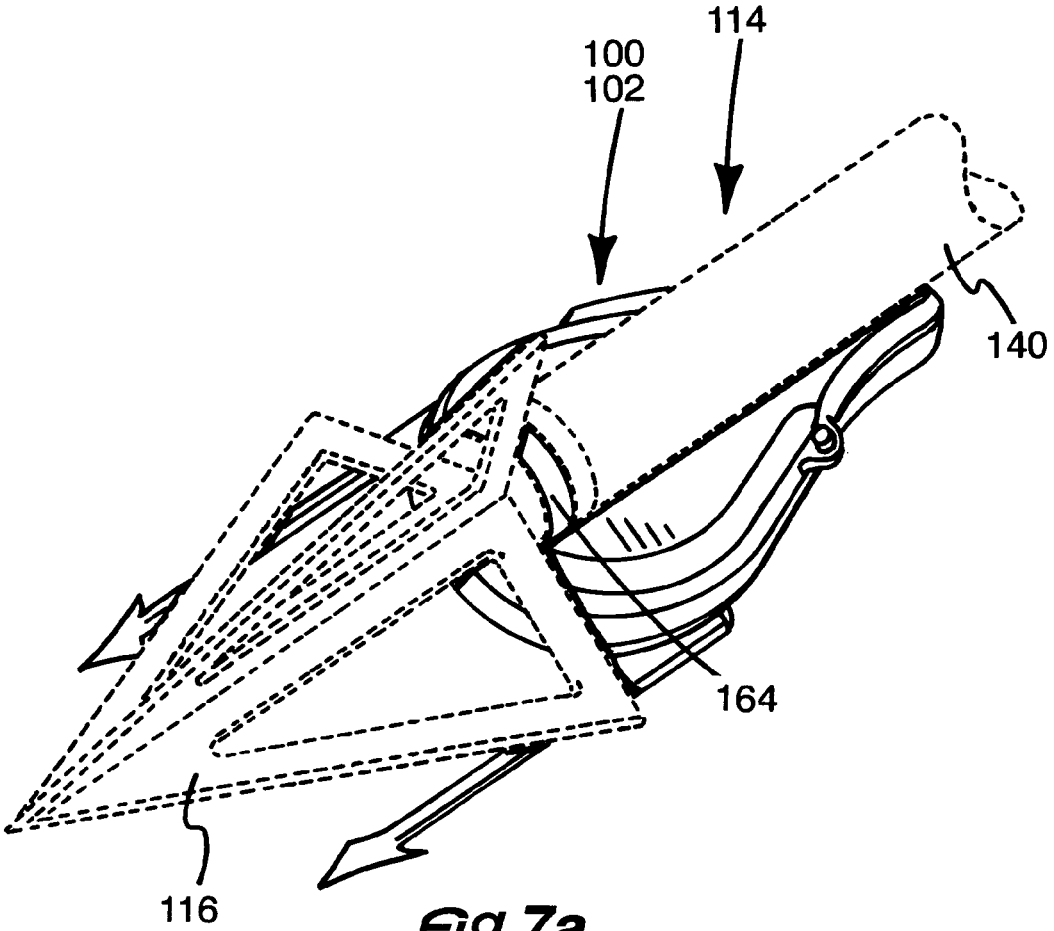
FIG. 7*a* depicts a top, perspective view of sending unit 102 attached to arrow 114, with broad head 116 and arrow shaft 140 depicted in phantom.
Figure 7B:
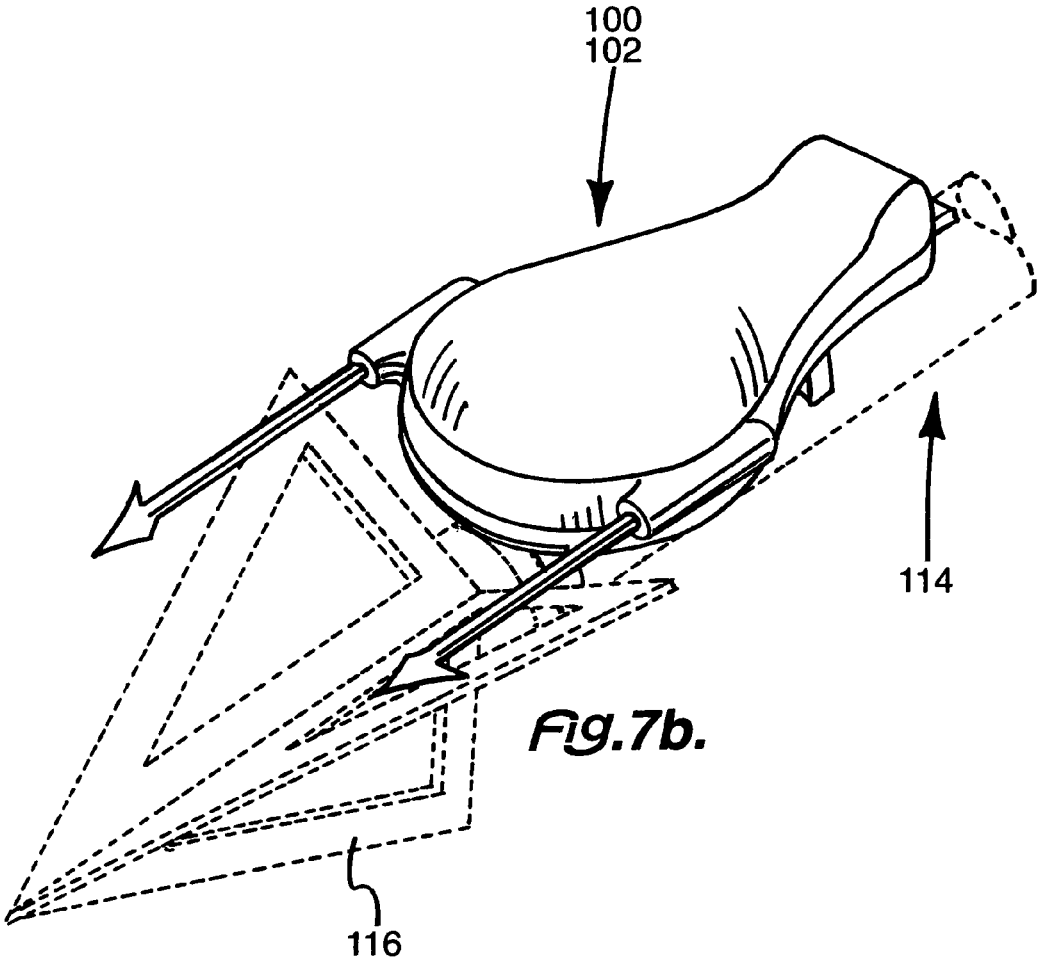
FIG. 7*b* depicts a bottom, perspective view of sending unit 102 attached to arrow 114, with broad head 116 and arrow shaft 140 depicted in phantom.
Figure 7C:
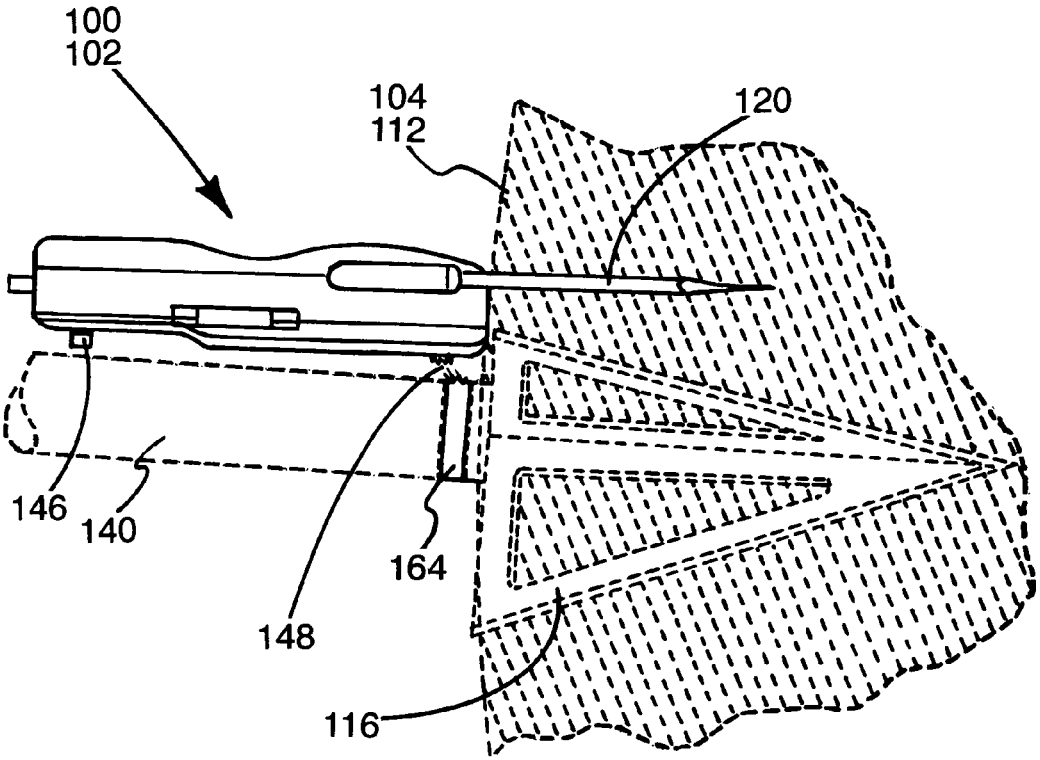
FIG. 7*c* depicts a side view of sending unit 102 breaking away from arrow 114 with sending unit 102 remaining with struck animal 104 while arrow 114 traverses the body, with broad head 116 and arrow shaft 140 depicted in phantom.
Figure 7D:
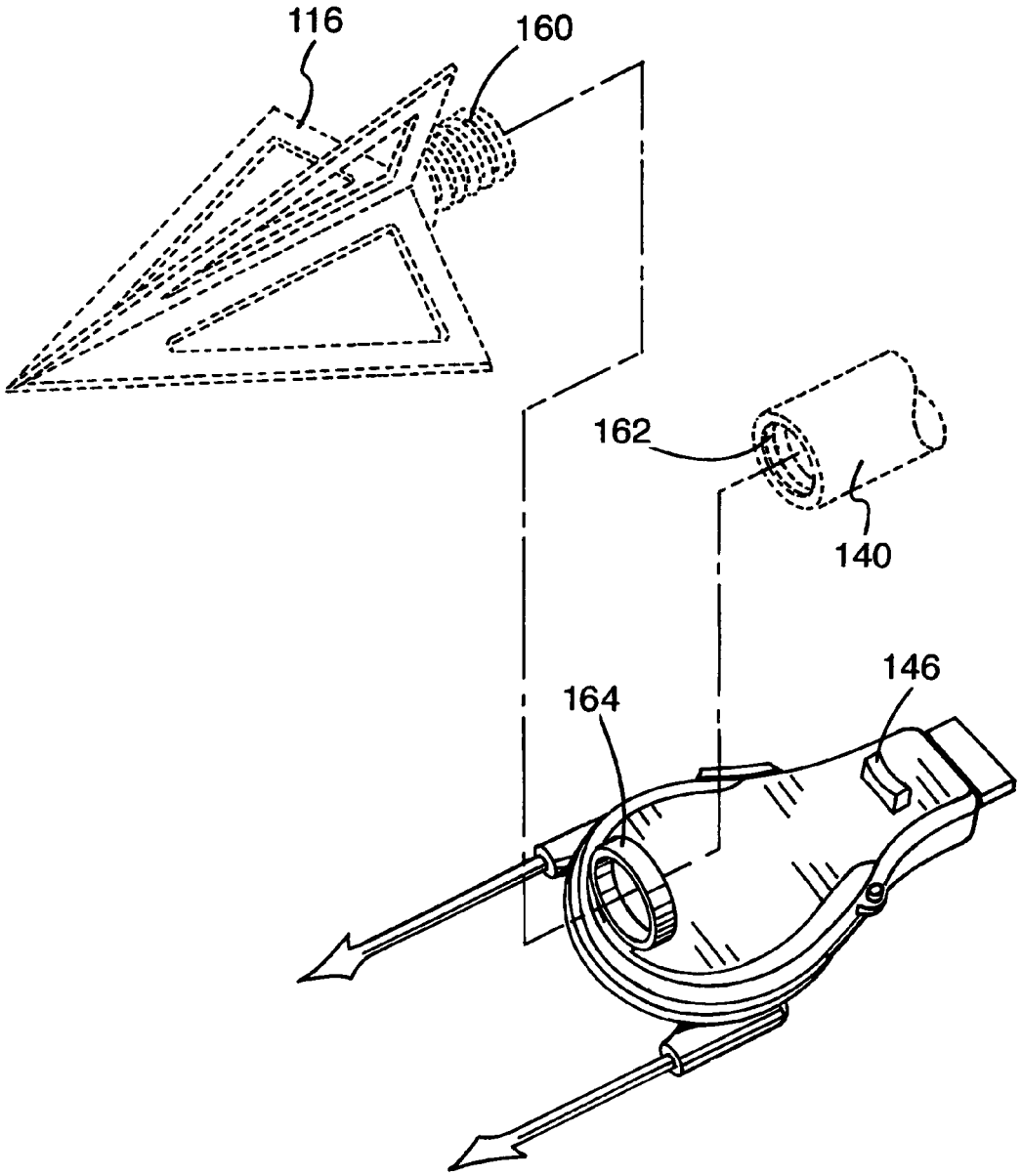
FIG. 7*d* depicts an exploded perspective view of sending unit 102 attached to arrow 114, with broad head 116, male threads 160, female threads 162, and arrow shaft 140 depicted in phantom.

All sending units 102 still send signals 224 but receiving unit 200 will only receive signals 224 from the specific tag circuit board 142 which correlates with the unique identification 294 entered by the hunter (See FIG. 7). Also, unique identification 294 prevents interference from cell phones, other tracking devices, and any other device in the area (See FIG. 7). Memory section 230 is also depicted (See FIG. 42).

Again these Figures are meant to illustrate a potential memory bar code circuit 292 that can be used with tracking device 100 and is in no way meant to limit the scope of this disclosure. Any suitable memory bar code circuit 292 which can be properly connected and utilized with this invention is encompassed by this disclosure.

Figure 33:
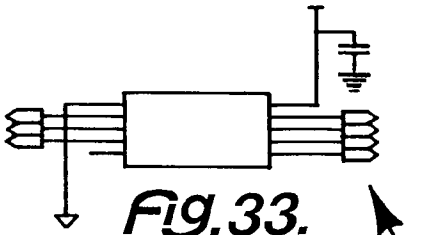
FIG. 33 depicts a schematic diagram of the digital compass program connector 302 of the receiving unit 200.
Figure 32:
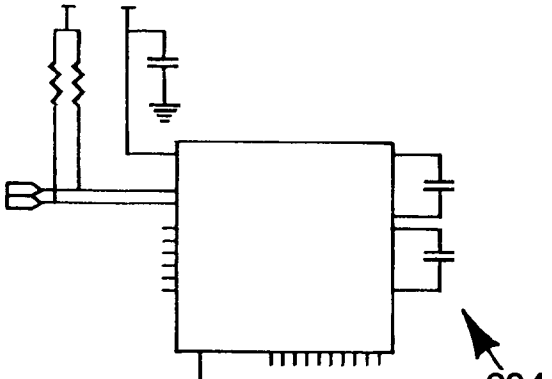
FIG. 32 depicts a schematic diagram of the digital compass 250 of receiving unit 200.

Now adding FIG. 32 and FIG. 33 to the consideration, the structure and function of digital compass 250 of receiving unit 200 can be clearly seen. Digital compass 250 provides direction to the hunter. Digital compass 250 determines changes in position and communicates this information to controller 244. Digital compass 250 is connected to the circuitry of the receiving unit 200 through digital compass program connector 302. Also, communication section 234 is depicted (FIG. 42).

Again these Figures are meant to illustrate a potential digital compass 250 and digital compass program connector 302 that can be used with tracking device 100 and is in no way meant to limit the scope of this disclosure. Any suitable digital compass 250 and digital compass program connector 302 which can be properly connected and utilized with this invention is encompassed by this disclosure.

Figure 35:
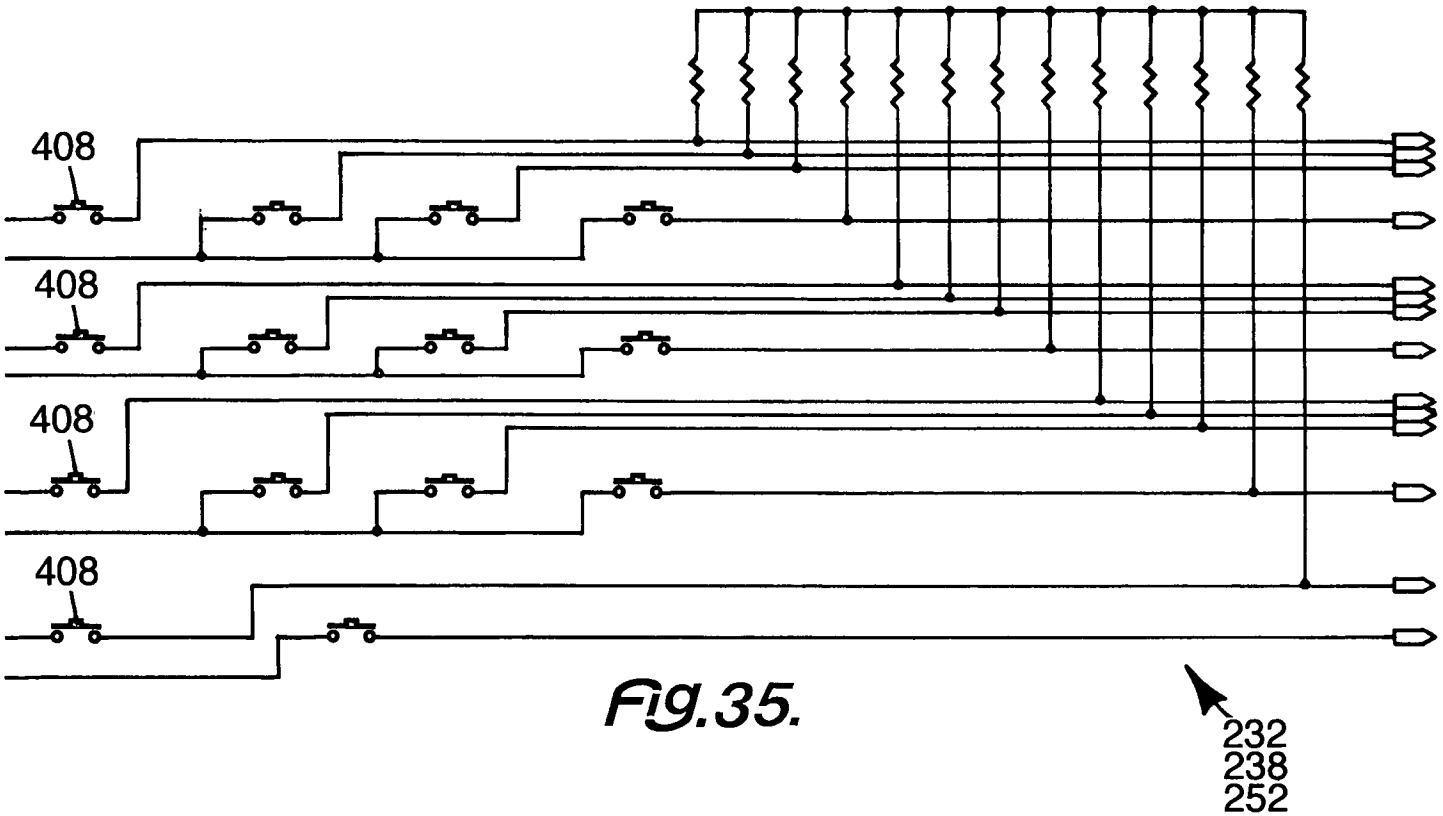
FIG. 35 depicts a schematic diagram of keypad section 238 of receiving unit 200.
Figure 36:
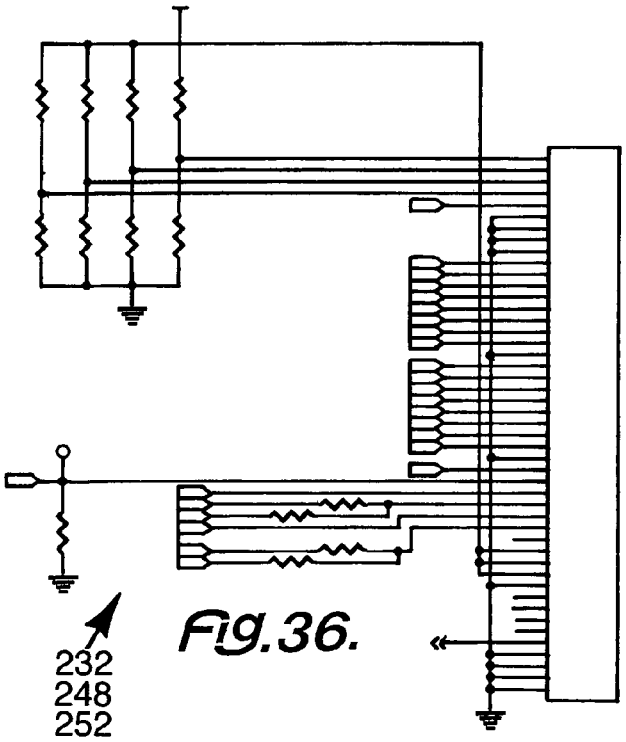
FIG. 36 depicts a schematic diagram of display section 248 of receiving unit 200.

Now adding FIG. 35 to the consideration, the function and structure of keypad section 238 of receiving unit 200 can be clearly seen. Keypad 226 allows the hunter to communicate with receiving unit 200. The unique identification 294 is entered into the receiving unit 200 through buttons 204 on keypad 226 (See FIG. 7 and FIG. 10). For example, the numbers associated with memory bar code 294 may be inputted into the receiving unit 200 to allow it to find the sending unit 102 through RFD technology.

Keypad 226 has a series of keypad switches 408. As each numerical button 204 is pressed and released, keypad switches 408 open and close to transmit unique identification 294 or other information to controller 244 (See FIG. 7 and FIG. 10).

Also, timing section 232 and animal tracking receiver 252 are depicted (See FIG. 42).

Again these Figures are meant to illustrate a potential keypad section 238 that can be used with tracking device 100 and is in no way meant to limit the scope of this disclosure. Any suitable keypad section 238 which can be properly connected and utilized with this invention is encompassed by this disclosure.

Now adding FIG. 36, FIG. 37, FIG. 38, FIG. 39, FIG. 40, and FIG. 41 to the consideration, the structure and function of display section 248 of receiving unit 200 can be clearly seen. Display section 248 provides the visual and audio readings to the hunter regarding the location of sending unit 102.

Figure 37:
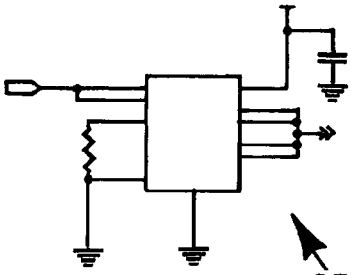
FIG. 37 depicts a schematic diagram of a Universal Serial Bus 254 with backlight controller 258 of receiving unit 200.
Figure 38:
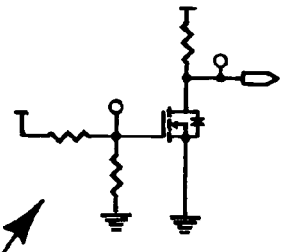
FIG. 38 depicts a schematic diagram of display section 248 of receiving unit 200.
Figure 39:
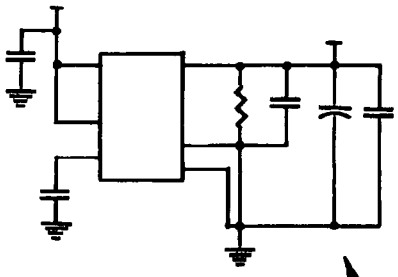
FIG. 39 depicts a schematic diagram of a 2.8 voltage regulator 274 of display section 248 of receiving unit 200.
Figure 40:
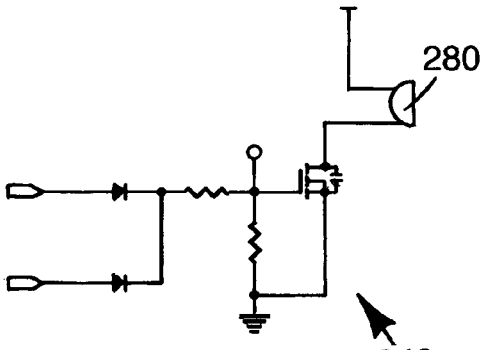
FIG. 40 depicts a schematic diagram of the display section 248 with buzzer 280 of receiving unit 200.
Figure 41:
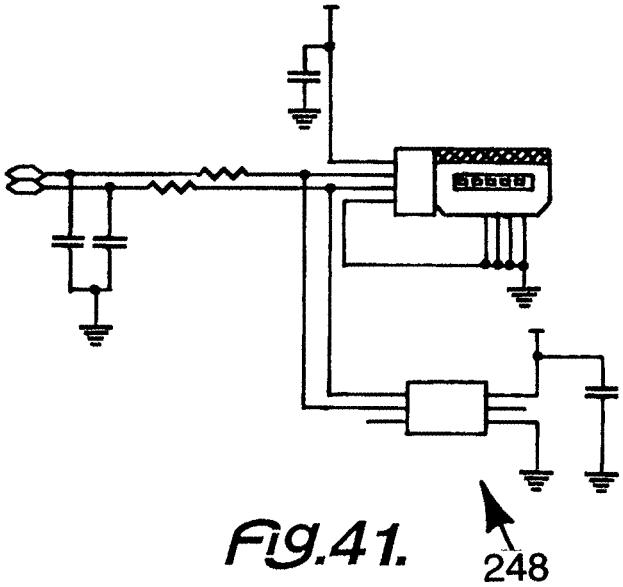
FIG. 41 depicts a schematic diagram of the display section 248 of receiving unit 200.

Referring specifically to FIG. 37, display section 248 has backlight controller 258 which provides contrast in lighting so the hunter can more easily and readily utilize display section 248, especially during low light periods such as dawn, dusk, and rain showers. A Universal Serial Bus (hereinafter "USB") 254 provides power to the display section 248. Display section 248 has circuitry to communicate with receiving unit battery 262. USB 254 receives power and voltage from an external power source. USB 254 may utilize adapter 256 to provide a connection between it and the external power source (See FIG. 44). USB 254 cooperates with battery charger circuit 260 to provide power to recharge receiving unit battery 262. In FIG. 39, display section 248 has a 2.8 voltage regulator 274. In FIG. 40, display section 248 has buzzer 280 to provide audio readings to the user.

Also, timing section 232, animal tracking receiver 252 are depicted (See FIG. 42).

Again these Figures are meant to illustrate a potential display section 248, backlight controller 258, USB 254, 2.8 voltage regulator 274, and buzzer 280 that can be used with tracking device 100 and is in no way meant to limit the scope of this disclosure. Any suitable display section 248, backlight controller 258, USB 254, 2.8 voltage regulator 274, and buzzer 280 which can be properly connected and utilized with this invention is encompassed by this disclosure.

Display section 248 can provide much information regarding the location of sending unit 102 through screen 202 on receiving unit 200 (See FIG. 10). For example, display section 248 can indicate through screen 202 the strength of the signals 224 originating from sending unit 102. A visible indication of the strength of the signals 224 appears on screen 202. The visible indication can be numbers, bars, or any other suitable identifier. As the hunter moves closer to the sending unit 102, the strength of signals 224 increase and the screen 202 reflects these changes by increasing the value of the number or by other suitable indications. On the other hand, as the hunter moves away from sending unit 102, the strength of signals 224 decrease and screen 202 reflects these changes by decreasing the value of the number or by other suitable indications. The strength of signals 224 can increase or decrease based on if the receiving unit antenna 222 is pointed in the correct or incorrect direction of sending unit 102.

Also, display section 248, through digital compass 250 and receiving unit 200, can provide directional clues about the location of sending unit 102. An arrow or other directional indicator appears on screen 202. The arrow or other directional indicator will point or otherwise notate the direction where the signals 224 are originating. The hunter can use the directional indicator atone or in combination with the signal strength indicator to aid in finding sending unit 102.

Referring specifically to FIG. 40, display section 248 has an audio section 240 to provide an audio sound to the hunter to provide information about the location of sending unit 102. Audio section 240 uses buzzer 280 to provide the audio sound to the hunter. The audio section 240 and the buzzer 280 receive power through USB 254 or receiving unit battery 262.

Buzzer 280 can provide a variety of audio clues about the location and direction of sending unit 102. For example, buzzer 280 may beep at a predetermined interval of time. As the hunter approaches sending unit 102 and the strength of signals 224 increase, the beeps may occur more frequently. As the hunter moves away from sending unit 102, the strength of signals 224 decrease and the beeps may occur less frequently. Also, if receiving unit antenna 222 is pointed in the direction of sending unit 102, the strength of signals 224 increase and the beeps may occur more frequently. If receiving unit antenna 222 is pointed away from the direction of sending unit 102, the strength of signals 224 decrease and the beeps may occur less frequently.

The audio frequency is preset in the sending unit 102 and the receiving unit 200. Thus, the channel is perfectly preset so that receiving unit 200 can receive signals 224 and allow audio section 240 to function properly.

Now adding FIG. 42 to the consideration, the function of receiving unit 200 cans be clearly seen. Controller 244 communicates with various sections of receiving unit 200. Receiving unit antenna 222 of receiving unit 200 receives signals 224 from sending unit 102. Receiving unit antenna 222 transmits this information to animal tracking receiver 252 which sends and receives information to and from controller 244. Controller 244 sends this information to communication section 234 which processes it and sends information back to controller 244 regarding the sending unit 102. Communication section 234 can report information regarding the strength of signals 224, an estimated distance between receiving unit 200 and sending unit 102, and an estimate of the area where sending unit 102 is located.

Controller 244 sends the information it receives from communication section 234 to audio section 240 and display section 248. Controller 244 sends both visual and audio signals to the hunter through display section 248 and audio section 240. The display section 248 on receiving unit 200 sends the hunter graduated numerical readings regarding the proximity of the sending unit 102. Audio section 240 sends an audible sound to the hunter to denote the proximity of the sending unit 102.

Controller 244 also sends and receives information from digital compass 250. Controller 244 sends information from digital compass 250 to display section 248 to give the hunter directional information such as North, South, East and West readings regarding the location of sending unit 102. Also, digital compass 250 can indicate degree information such as telling the hunter to turn 90 degrees to the right or 180 degrees to the left and so forth. Digital compass 250 also sends directional readings to controller 244 to orient receiving unit 200 as it is moved.

The hunter can input information such as the unique identification 294 through the keypad section 238 and keypad 226 (See FIG. 7 and FIG. 10). Keypad section 238 sends the unique identification 294 and other information to controller 244 (See FIG. 7). Controller 244 sends the unique identification 294 and other information to memory section 230 which stores the information so that controller 244 can readily access it (See FIG. 7).

Finally, controller 244 sends and receives information from timing section 232. Timing section 232 provides the controller 244 with the time, date, and other temporal information. Controller 244 sends the temporal information to display section 248 so that it may be presented to the hunter.

Now adding FIG. 43 to the consideration, the structure and function of sending unit 102 can be clearly seen. Tag battery 136 can be the lithium coin cell battery 286 depicted in the block diagram or any other suitable battery. Lithium coin cell battery 286 provides power to the sending unit 102 so that it is able to send and receive signals 224 to receiving unit 200.

Tag circuit board 142 has tag controller 284 and antenna matching circuit 288. Tag controller 284 sends and receives information from antenna matching circuit 288 which includes signals 224 from receiving unit 200.

Tag antenna 144 can be a 915 megahertz printed circuit board antenna 290 as depicted in this block diagram or any other suitable antenna. Antenna 290 receives signals 224 from receiving unit antenna 222 on receiving unit 200. Antenna matching circuit 288 matches the impedance of the antenna to the tag controller 284 to improve the distance the receiving unit 200 can be from the sending unit 102 and still function through RFID technology.

Now adding FIG. 44 to the consideration, the structure and function of the power supply to receiving unit 200 can be clearly seen. Battery charger circuit 260 receives voltage from adapter 256 through USB 254. Battery charger circuit 260 charges 3.7 voltage receiving unit battery 262. Receiving unit battery 262 is depicted as a 3.7 voltage battery but any suitable battery can be utilized. Receiving unit battery 262 powers on/off circuit 270 which activates and deactivates display section 248.

Battery switching circuit 272 allows power from receiving unit battery 262 to be alternatively delivered to the 3.3 voltage regulator 276 or the 5 voltage regulator 278. The 5 voltage regulator 278 in turn powers battery charger circuit 260 while the 3.3 voltage regulator 276 powers the on/off circuit 270.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. An electronic game tracking device to aid a user in tracking a wounded or downed game animal comprising:

a) the electronic tracking device having a sending unit and a receiving unit;

b) the sending unit being attachable to an arrow;

c) the sending unit including a housing;

d) the sending unit emitting a signal to be received by the receiving unit or the receiving unit emitting the signal to be received by the sending unit and either permitting tracking of the game animal;

e) the electronic game tracking device using radio frequency identification technology to track the game animal;

f) the sending unit having at least one barb to hold the sending unit with the game animal even if the arrow fails to remain with the game animal;

g) a releasable securing means securing the sending unit to the arrow behind an arrowhead and beneath an arrow shaft;

h) the sending unit being releasable from the arrow in order to remain in the game animal through the at least one barb even if the arrow traverses a body of the game animal;

i) the sending unit having a tag circuit board, a tag antenna, and a tag battery;

j) the receiving unit having a receiving unit antenna;

k) the tag circuit board emitting the signal to the receiving unit through the tag antenna and the receiving unit receiving the signal through the receiving unit antenna;

l) the radio frequency identification technology allowing the sending unit to be tracked by the receiving unit even if the sending unit is blocked by the game animal or other environmental factor;

m) the at least one barb extending from the housing of the sending unit;

n) the at least one barb lacking interference with penetration or movement of the arrow relative to the game animal;

o) the receiving unit having a battery charger circuit to charge a receiving unit battery;

p) the tag circuit board battery section to allow the sending unit to cooperate with the tag battery;

q) the receiving unit having a controller; and r) the sending unit having a tag controller.

2. The electronic game tracking device of claim 1 further comprising:

a) the receiving unit having an on/off circuit to allow the receiving unit to be activated and deactivated;

b) the receiving unit having a display section;

c) the receiving unit having a memory section with a memory bar code circuit;

d) the receiving unit having a digital compass to provide a directional information to aid the user in locating the sending unit;

e) the receiving unit having an audio section;

f) the receiving unit having a timing section to provide a temporal information to the user; and g) the sending unit being small in size and weight.

3. The electronic game tracking device of claim 2 further comprising:

a) a digital compass program connector allowing the digital compass to interact with a circuitry of the receiving unit;

b) the sending unit having an amplifier;

c) the battery charger circuitry of the receiving unit having a battery switching circuit;

d) the on/off circuit having an operational amplifier section;

e) the display section providing a visual feedback to a user regarding the position of the sending unit;

f) the audio section having a buzzer to provide an audio feedback to the user regarding the position of the sending unit; and g) the memory section with the memory bar code circuit allowing the user to locate a specific tag circuit board.

4. The electronic game tracking device of claim 3 further comprising:

a) the housing of the sending unit having a housing base and a housing lid;

b) a hinge connecting the housing base to the housing lid;

c) a releasable fastening device cooperating with the hinge to make the housing openable or closable as desired;

d) the housing containing the tag circuit board, the tag battery and the tag antenna;

e) the housing protecting the tag circuit board, the tag battery, and the tag antenna during use of the electronic game tracking device;

f) the tag circuit board having a unique identification;

g) the receiving unit having a key pad;

h) the user being able to input the unique identification into the receiving unit through the key pad;

i) the receiving unit through the memory section with the memory bar code circuit being able to locate a specific sending unit associated with the inputted unique identification;

j) the releasable securing means of the sending unit being a mount collar and a break away seam mounted on the housing lid; and k) a mount rest being mounted on the housing lid of the sending unit.

5. The electronic game tracking device of claim 4 further comprising:

a) the housing base of the sending unit including at least one barb cradle;

b) the at least one barb cradle receiving the at least one barb;

c) the at least one barb being a first barb and a second barb;

d) the unique identification being a memory bar code attached to the tag circuit board which is read by the memory bar code section of the receiving unit through the RFID technology;

e) the battery charger circuitry of the receiving unit having a 5 volt regulator;

f) the on/off circuit of the receiving unit having a 3.3 volt regulator;

g) the receiving unit cooperating with a universal serial bus; and h) the receiving unit having a backlight controller.

6. The electronic game tracking device of claim 5 further comprising:

a) the receiving unit having an outer housing;

b) the outer housing including a receiving unit base and a receiving unit cover;

c) a receiving unit circuit board being positioned between the receiving unit base and the receiving unit cover;

d) a threaded cable screw connecting a coaxial cable to the receiving unit;

e) a threaded antenna screw attaching the receiving unit antenna to the coaxial cable;

f) the receiving unit base having an antenna cradle to receive the receiving unit antenna;

g) the housing of the sending unit including a battery pull strip gate;

h) a battery pull strip being housed in the battery pull strip gate;

i) the tag battery being removable through the battery pull strip gate with the battery pull strip;

j) the receiving unit having a screen; and k) the releasable fastening device of the sending unit cooperating with the hinge being a snap clasp.

7. In an electronic game tracking device to aid a user in tracking a wounded or downed game animal, the improvement comprising:

a) the electronic tracking device having a sending unit and a receiving unit;

b) the sending unit being attachable to an arrow;

c) the sending unit including a housing;

d) the sending unit emitting a signal to be received by the receiving unit or the receiving unit emitting a signal to be received by the sending unit and either permitting tracking of the game animal;

e) the electronic game tracking device using radio frequency identification technology to track the game animal;

f) the sending unit having at least one barb to hold the sending unit with the game animal even if the arrow fails to remain with the game animal;

g) a releasable securing means securing the sending unit to the arrow behind an arrowhead and beneath an arrow shaft;

h) the sending unit being releasable from the arrow in order to remain in the game animal due to the at least one barb even if the arrow traverses a body of the game animal;

i) the sending unit having a tag circuit board, a tag antenna, and a to battery;

j) the receiving unit having a receiving unit antenna;

k) the tag circuit board emitting the signal to the receiving unit through the tag antenna and the receiving unit receiving the signal through the receiving unit antenna;

l) the radio frequency identification technology allowing the sending unit to be tracked by the receiving unit even if the sending unit is blocked by the game animal or other environmental factor;

m) the at least one barb extending from the housing of the sending unit;

n) the at least one barb lacking interference with penetration or movement of the arrow relative to the game animal;

o) the receiving unit having a battery charger circuit to charge a receiving unit battery;

p) the tag circuit board having a battery section to allow the sending unit to cooperate with the tag battery;

q) the receiving unit having a controller; and r) the sending unit having a tag controller.

8. The electronic game tracking device of claim 7 further comprising:

a) the receiving unit having an on/off circuit to allow the receiving unit to be activated and deactivated;

b) the receiving unit having a display section;

c) the receiving unit having a memory section with a memory bar code circuit;

d) the receiving unit having a digital compass to provide a directional information to aid the user in locating the sending unit;

e) the receiving unit having an audio section;

f) the receiving unit having a timing section to provide a temporal information to the user and g) the sending unit being small in size and weight.

9. The electronic game tracking device of claim 8 further comprising:

a) a digital compass program connector allowing the digital compass to interact with a circuitry of the receiving unit;

b) the sending unit having an amplifier;

c) the battery charger circuit having a battery switching circuit;

d) the on/off circuit having an operational amplifier section;

e) the display section providing a visual feedback to the user regarding the position of the sending unit;

f) the audio section having a buzzer to provide an audio feedback to the user regarding the position of the sending unit; and g) the memory section with memory bar code circuit allowing the user to locate a specific tag circuit board.

10. The electronic game tracking device of claim 9 further comprising:

a) the housing of the sending unit having a housing base and housing lid;

b) a hinge connecting the housing base to the housing lid;

c) a releasable fastening device cooperating with the hinge to make the housing openable or closable as desired;

d) the housing containing the tag circuit board, the tag battery and the tag antenna;

e) the housing protecting the tag circuit board, the tag battery, and the tag antenna during a use of the electronic game tracking device;

f) the tag circuit board having a unique identification;

g) the receiving unit having a key pad;

h) the user being able to input the unique identification into the receiving unit through the key pad;

i) the receiving unit, through the memory section with the memory bar code circuit, being able to locate a specific sending unit associated with the inputted unique identification;

j) the releasable securing means being a mount collar and a break away seam mounted on the housing lid of the sending unit; and k) a mount rest being mounted on the housing lid of the sending unit.

11. The electronic game tracking device of claim 10 further comprising:

a) the housing base of, the sending unit, including at least one barb cradle;

b) the at least one barb cradle receiving the at least one barb;

c) the at least one barb being a first barb and a second barb;

d) the unique identification being a memory bar code attached to the tag circuit board which is read by the memory bar code section of the receiving unit through the RFID technology;

e) the battery charger circuit, of the receiving unit, having a 5 volt regulator;

f) the on/off circuit, of the receiving unit, having a 3.3 volt regulator;

g) the receiving unit cooperating with a universal serial bus; and h) the receiving unit having a backlight controller.

12. The electronic game tracking device of claim 11 further comprising:

a) the receiving unit having an outer housing;

b) the outer housing including a receiving unit base and a receiving unit cover;

c) a receiving unit circuit board being positioned between the receiving unit base and the receiving unit cover;

d) a threaded cable screw connecting a coaxial cable to the receiving unit;

e) a threaded antenna screw attaching the receiving unit antenna to the coaxial cable;

f) the receiving unit base having an antenna cradle to receive the receiving unit antenna;

g) the housing, of the sending unit, including a battery pull strip gate;

h) a battery pull strip being housed in the battery pull strip gate;

i) the tag battery being removable through the battery pull strip gate with the battery pull strip;

j) the receiving unit having a screen; and k) the releasable fastening device cooperating with the hinge being a snap clasp.

13. A method for electronically tracking a wounded or downed game animal once it has been struck with an arrow, the method comprising:

a) using an electronic tracking device to track the game animal;

b) providing the electronic tracking device with a sending unit and a receiving unit;

c) releasably securing the sending unit to the arrow with a releasable securing means behind an arrowhead and beneath an arrow shaft;

d) emitting a signal through the sending unit which is received by the receiving unit or emitting the signal through the receiving unit which is received by the sending unit;
e) communicating a position of the sending unit to the receiving unit through the signal;
f) using radio frequency identification to allow communication between the sending unit and the receiving unit;
g) providing the sending unit with a tag circuit board, a tag antenna, and a tag battery;
h) providing the receiving unit with a receiving unit antenna;
i) allowing the tag circuit board to emit the signal through the tag antenna and allowing the receiving unit to receive the signal through the receiving unit antenna;
j) providing the sending unit with at least one barb to hold the sending unit with the am animal even if the arrow fails to remain with the game animal;
k) allowing the sending unit to be tracked by the receiving unit, through the radio frequency identification technology, even if the sending unit is blocked by the game animal or other environmental factor;
l) extending the at least one barb from the housing of the sending unit;
m) allowing the at least one barb to hold the sending unit with the game animal while allowing the at least one barb to lack interference with penetration or movement of the arrow relative to the game animal;
n) providing the receiving unit with a battery charger circuit to charge a receiving unit battery;
o) providing the tag circuit board with a battery section to allow the sending unit to cooperate with the tag battery;
p) providing the receiving unit with a controller;
g) providing the sending unit with a tag controller; and
r) providing the receiving unit with an on/off circuit to allow the receiving unit to be activated and deactivated.

14. The method of claim 13 further comprising:
a) providing the receiving unit with a display section;
b) providing the receiving unit with a memory section with a memory bar code circuit;
c) providing the receiving unit with a digital compass to provide a directional information to aid the user in finding the sending unit;
d) providing the receiving unit with an audio section;
e) providing the receiving unit with a timing section to provide a temporal information to the user; and
f) providing the sending unit as being small in size and weight.

15. The method of claim 14 further comprising:
a) providing a digital compass program connector to allow the digital compass to interact with a circuitry of the receiving unit;
b) providing the sending unit with an amplifier;
c) providing the battery charger circuit of the receiving unit with a battery switching circuit;
d) providing the on/off circuit of the receiving unit with an operational amplifier section;
e) using the display section of the receiving unit to provide a visual feedback to the user regarding the position of the sending unit;
f) providing the audio section with a buzzer to provide an audio feedback to the user regarding the position of the sending unit; and
g) allowing the user to locate a specific tag circuit board through the memory section with the memory bar code circuit of the receiving unit.

16. The method of claim 15 further comprising:
a) providing the housing of the sending unit with a housing base and a housing lid;
b) connecting the housing base to the housing lid through a hinge;
c) providing a releasable fastening device to cooperate with the hinge to make the housing openable or closable as desired;
d) containing the tag battery, the tag circuit board, and the tag antenna within the housing of the sending unit;
e) protecting the tag battery, the tag circuit board, and the tag antenna with the housing during a use of the electronic game tracking device;
f) providing each tag circuit board with a unique identification;
g) providing the receiving unit with a key pad;
h) allowing the user to input the unique identification into the receiving unit through the key pad so the memory section with the memory bar code circuit can locate a specific sending unit connected to the inputted unique identification which is read by the memory bar code section of the receiving unit through the RFID technology;
i) providing the releasable securing means as a mount collar and a break away seam mounted on the housing lid of the sending unit; and
j) mounting a mount rest on the housing lid of the sending unit.

17. The method of claim 16 further comprising:
a) providing a battery pull strip gate within the housing of the sending unit;
b) housing a battery pull strip within the battery pull strip gate;
c) removing the tag battery through the battery pull strip gate with the battery pull strip;
d) having the receiving unit cooperate with a universal serial bus;
e) providing the receiving unit with a backlight controller;
f) providing the housing base of the sending unit with at least one barb cradle;
g) allowing the at least one barb cradle to receive the at least one barb;
h) providing the at least one barb as a first barb and a second barb;
i) providing the unique identification as a memory bar code attached to the tag circuit board;
j) providing the battery charger circuit of the receiving unit with a 5 volt regulator;
k) providing the on/off circuit of the receiving unit with a 3.3 volt regulator;
l) providing the receiving unit with an outer housing;
m) providing the outer housing with a receiving unit base and a receiving unit cover;
n) positioning a receiving unit circuit board between the receiving unit base and the receiving unit cover;
o) connecting a coaxial cable to the receiving unit with a threaded cable screw;
p) attaching the receiving unit antenna to the coaxial cable with a threaded antenna screw;
q) providing the receiving unit base with an antenna cradle to receive the receiving unit antenna;
r) providing the receiving unit with a screen; and
s) providing the releasable fastening device cooperating with the hinge as a snap clasp.

* * * * *